US012396517B1

(12) United States Patent
Ludwigsen

(10) Patent No.: US 12,396,517 B1
(45) Date of Patent: Aug. 26, 2025

(54) MODULAR FOOTWEAR AND METHODS OF USE THEREOF

(71) Applicant: Keith Ludwigsen, North Bay Village, FL (US)

(72) Inventor: Keith Ludwigsen, North Bay Village, FL (US)

( * ) Notice: Subject to any disclaimer, the term of this patent is extended or adjusted under 35 U.S.C. 154(b) by 0 days.

(21) Appl. No.: 19/093,785

(22) Filed: Mar. 28, 2025

(51) Int. Cl.
*A43B 13/36* (2006.01)
*A43B 3/24* (2006.01)
*A43B 11/00* (2006.01)

(52) U.S. Cl.
CPC ..... *A43B 13/36* (2013.01); *A43B 3/24* (2013.01); *A43B 3/244* (2013.01); *A43B 11/00* (2013.01)

(58) Field of Classification Search
CPC ..... A43B 13/36; A43B 3/24; A43B 3/244
USPC ..... 36/100, 101, 15
See application file for complete search history.

(56) References Cited

U.S. PATENT DOCUMENTS 2,495,984 A * 1/1950 Roy ..... A43B 13/36 36/15
3,059,350 A 10/1962 Price
3,318,025 A * 5/1967 Barriga ..... A43B 13/36 36/36 B
3,538,628 A * 11/1970 Einstein, Jr. ..... A43B 3/0078 36/15
4,317,294 A * 3/1982 Goodyear ..... A43B 13/36 36/36 B
4,377,042 A * 3/1983 Bauer ..... A43B 13/36 36/15
4,420,894 A * 12/1983 Glassman ..... A43B 13/36 36/12
5,317,822 A * 6/1994 Johnson ..... A43B 13/36 36/15
6,880,268 B2 4/2005 Chen
7,434,336 B2 10/2008 Kosted
10,863,793 B2 12/2020 Bell et al.
2001/0018805 A1 9/2001 Basso
2004/0255486 A1* 12/2004 Pawlus ..... A43B 19/00 36/114
2005/0011083 A1* 1/2005 Kosted ..... A43B 1/0081 2/241
2006/0021260 A1* 2/2006 Kim ..... A43B 21/39 36/130
2006/0248748 A1 11/2006 Warren
2007/0028365 A1 2/2007 Williams
2007/0204482 A1 9/2007 Gibson-Collinson
2007/0271819 A1 11/2007 Chen
(Continued)

*Primary Examiner* — Marie D Bays
(74) *Attorney, Agent, or Firm* — Polsinelli PC

(57) ABSTRACT

Disclosed herein are footwear systems and methods of use thereof. The footwear system can include a foot cover and a base. The foot cover can be operable to secure around a foot of a wearer. The foot cover can include a bottom surface. The bottom surface can include a plurality of foot cover coupling mechanisms. The base can include an interior surface, a toe cover, and a heel support. The interior surface can include a plurality of base coupling mechanisms operable to removably couple to the plurality of foot cover coupling mechanisms. The toe cover can extend from a portion of the interior surface and be operable to enclose at least a toe portion of the foot cover. The heel support can extend from a portion of the interior surface and be operable to support a heel of the wearer.

19 Claims, 27 Drawing Sheets

(56) References Cited

U.S. PATENT DOCUMENTS

| | | | | |
|---|---|---|---|---|
| 2009/0183392 | A1* | 7/2009 | Shane | A43B 3/244<br>12/114.2 |
| 2012/0117817 | A1* | 5/2012 | Chamberlin | A43B 13/36<br>36/15 |
| 2012/0227281 | A1* | 9/2012 | Young | A43B 3/10<br>36/10 |
| 2014/0345162 | A1 | 11/2014 | Mitchell | |
| 2016/0029739 | A1* | 2/2016 | Dias | A43B 13/22<br>36/15 |
| 2018/0103721 | A1* | 4/2018 | Mulholland | A43B 3/244 |
| 2019/0142110 | A1* | 5/2019 | Cruz | A43B 3/16<br>36/15 |
| 2019/0216172 | A1* | 7/2019 | De Callatay | A43D 67/00 |
| 2022/0061455 | A1* | 3/2022 | Obier | A43B 7/20 |
| 2023/0000201 | A1* | 1/2023 | Brannon | A43B 3/24 |
| 2024/0122295 | A1* | 4/2024 | Matsuhisa | A43B 13/28 |

* cited by examiner

MODULAR FOOTWEAR AND METHODS OF USE THEREOF

FIELD OF DISCLOSURE

The present disclosure relates to footwear systems and methods of use thereof.

BACKGROUND

Current shoes do not provide modularity. For example, current market shoes do not allow users to replace a shoe sole with another shoe sole. Further, current market shoes do not allow for seamless transition from indoor to outdoor wear. Moreover, socks are not designed as foot coverings for insertion within shoes while also providing grip on indoor floors outside of shoes and thus can be improved.

Therefore, there is a need for a modular footwear system that allows wearers to interchangeably switch between different soles, allow for a seamless transition between indoor and outdoor wear, and provide an indoor wearable cover that provides additional floor grip and cushioning.

SUMMARY

Provided herein is a footwear system. The footwear system can include a foot cover and a base. The foot cover can be operable to secure around a foot of a wearer. The foot cover can include a toe portion, a heel portion, and a bottom surface. The bottom surface can include a plurality of foot cover coupling mechanisms. The base can include an interior surface, a toe cover, and a heel support. The interior surface can include a plurality of base coupling mechanisms. The plurality of base coupling mechanisms can be operable to removably couple to the plurality of foot cover coupling mechanisms. The toe cover can extend from a portion of the interior surface. The toe cover can be operable to enclose at least a toe portion of the foot cover. The heel support can extend from a portion of the interior surface. The heel support can be operable to support a heel of the wearer. The foot cover can be operatively engaged to the base when the toe portion of the foot cover is first enclosed by the toe cover, the plurality of foot cover coupling mechanisms can then be coupled to the plurality of base coupling mechanisms, and then the heel portion of the foot cover can be engaged to the heel support.

In some aspects, the foot cover can include a sock. In some aspects, the bottom surface can further include a sole. The plurality of foot cover coupling mechanisms can be attached to the sole. In some aspects, the plurality of foot cover coupling mechanisms can include protrusions extending from the bottom surface and the base coupling mechanisms can include indents into the interior surface. The protrusions can be configured to interlock with the indents.

In some aspects, the heel support can be removably coupled to the base. In some aspects, the plurality of foot cover coupling mechanisms and the plurality of base coupling mechanisms can include Velcro and/or snap fit mechanisms. In some aspects, the base can further include side supports. In some aspects, the side supports can extend from the toe cover to the base. In some aspects, the plurality of foot cover coupling mechanisms and the plurality of base coupling mechanisms can be arranged in a honeycomb array. In some aspects, the honeycomb array can cover substantially an entire surface of the bottom surface and the interior surface.

Further provided herein is a method for securing modular footwear. The method can include inserting a foot of a wearer into an opening of a foot cover. The foot cover can include a bottom surface. The bottom surface can include a plurality of foot cover coupling mechanisms. The method can further include inserting a toe area of the foot cover into a toe cover of a base. The base can include an interior surface. The interior surface can include a plurality of base coupling mechanisms. The method can further include pressing the toe area of the foot cover downward, thereby coupling one or more of the plurality of foot cover coupling mechanisms near the toe area to one or more of the plurality of base coupling mechanisms near the toe area. The method can further include pressing a heel area of the foot cover downward towards the base, thereby coupling one or more remaining coupling mechanisms of the plurality of foot cover coupling mechanisms to one or more remaining corresponding coupling mechanisms of the plurality of base coupling mechanisms.

In some aspects, the method can further include coupling a heel support to the base. The heel support can be operable to support a heel of the wearer. In some aspects, coupling the heel support to the base includes connecting at least one snap fit connector of the heel support to at least one corresponding snap fit connector of a heal support connector.

In some aspects, the method can further include removing the foot cover from the base by securing the base and pulling the one or more remaining coupling mechanisms away from the one or more remaining corresponding coupling mechanisms, thereby uncoupling the one or more remaining coupling mechanisms from the one or more remaining corresponding coupling mechanisms. In some aspects, removing the foot cover from the base further includes pulling the plurality of foot cover coupling mechanisms near the toe area away from the plurality of base coupling mechanisms near the toe area, thereby uncoupling the plurality of foot cover coupling mechanisms from the plurality of corresponding coupling mechanisms. In some aspects, the plurality of foot cover coupling mechanisms and the plurality of base coupling mechanisms are arranged in a honeycomb array. In some aspects, the honeycomb array covers substantially an entire surface of the bottom surface and the interior surface. In some aspects, the bottom surface of the foot cover includes a sole. The plurality of foot cover coupling mechanisms can be attached to the sole.

In some aspects, the plurality of foot cover coupling mechanisms include protrusions extending from the bottom surface and the base coupling mechanisms include indents into the interior surface. The protrusions can be configured to interlock with the indents. In some aspects, the plurality of foot cover coupling mechanisms and the plurality of base coupling mechanisms include Velcro and/or snap fit mechanisms.

BRIEF DESCRIPTION OF FIGURES

The description will be more fully understood with reference to the following figures, which are presented as various embodiments of the disclosure and should not be construed as a complete recitation of the scope of the disclosure. It is noted that, for purposes of illustrative clarity, certain elements in various drawings may not be drawn to scale. Understanding that these drawings depict only exemplary embodiments of the disclosure and are not therefore to be considered limiting of its scope, the principles herein are described and explained with additional specificity and detail through the use of the accompanying drawings in which.

Reference characters indicate corresponding elements among the views of the drawings. The headings used in the figures do not limit the scope of the claims.

DETAILED DESCRIPTION

Figure 1:
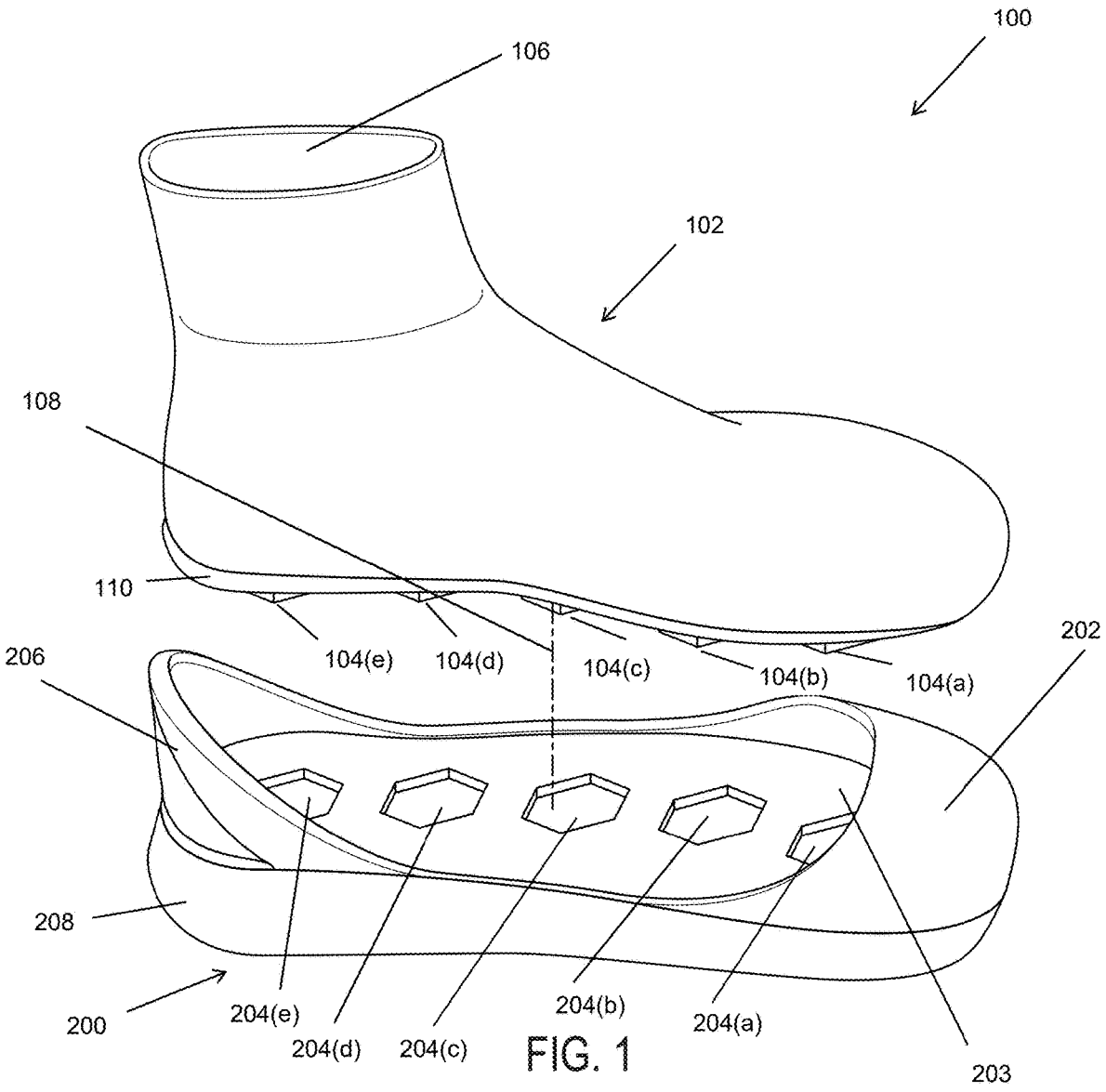
FIG. 1 is an isometric side view of a footwear system in one example.
Figure 2:
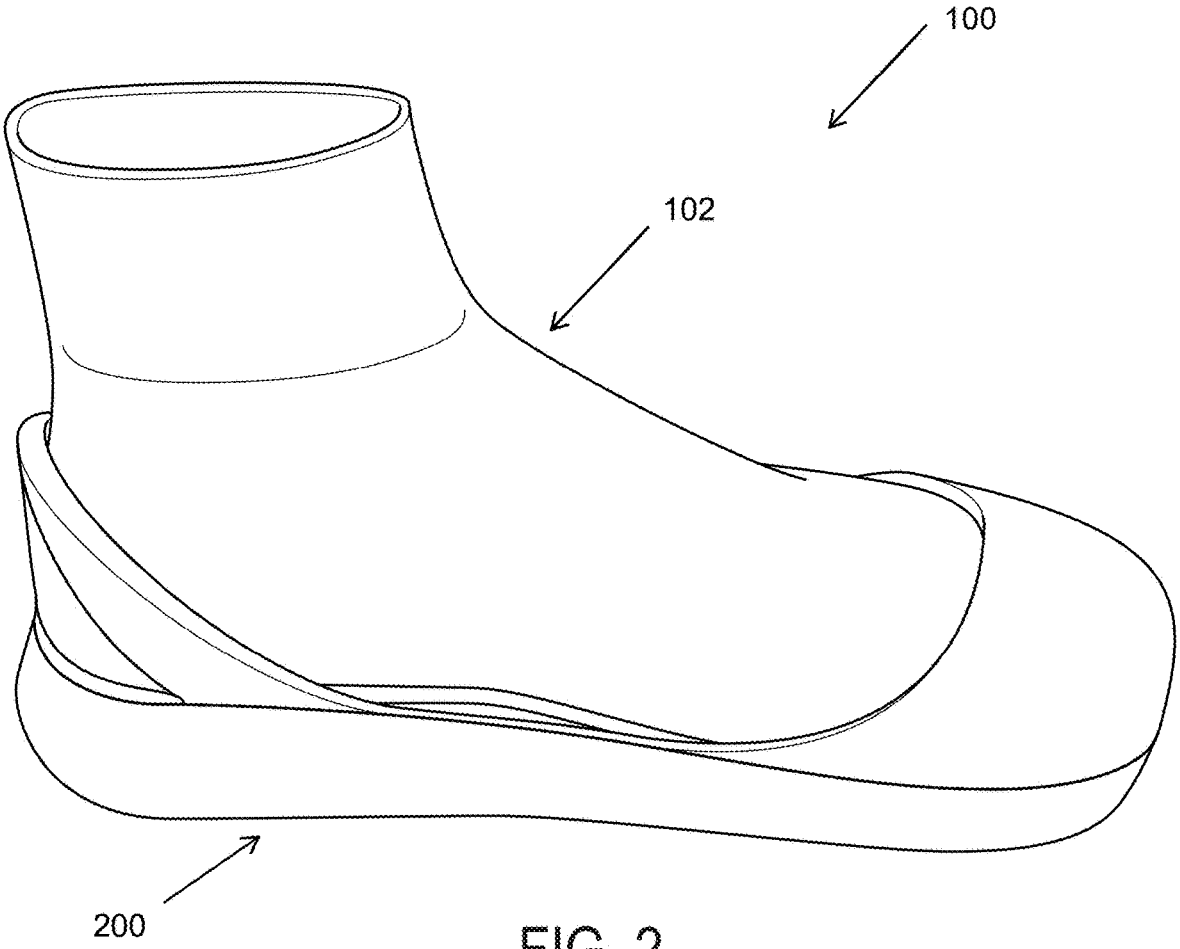
FIG. 2 is an isometric side view of a footwear system in one example.
Figure 3:
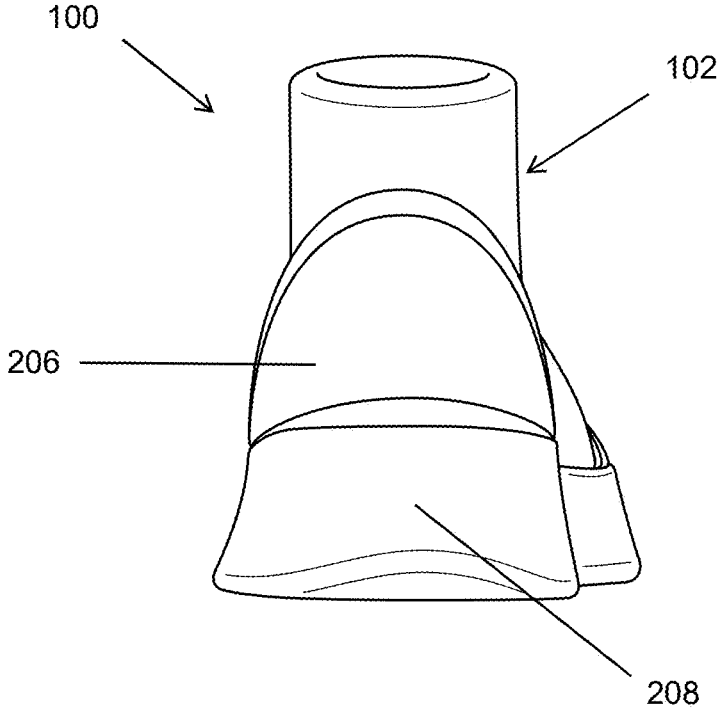
FIG. 3 is a rear view of a footwear system in one example.
Figure 4:
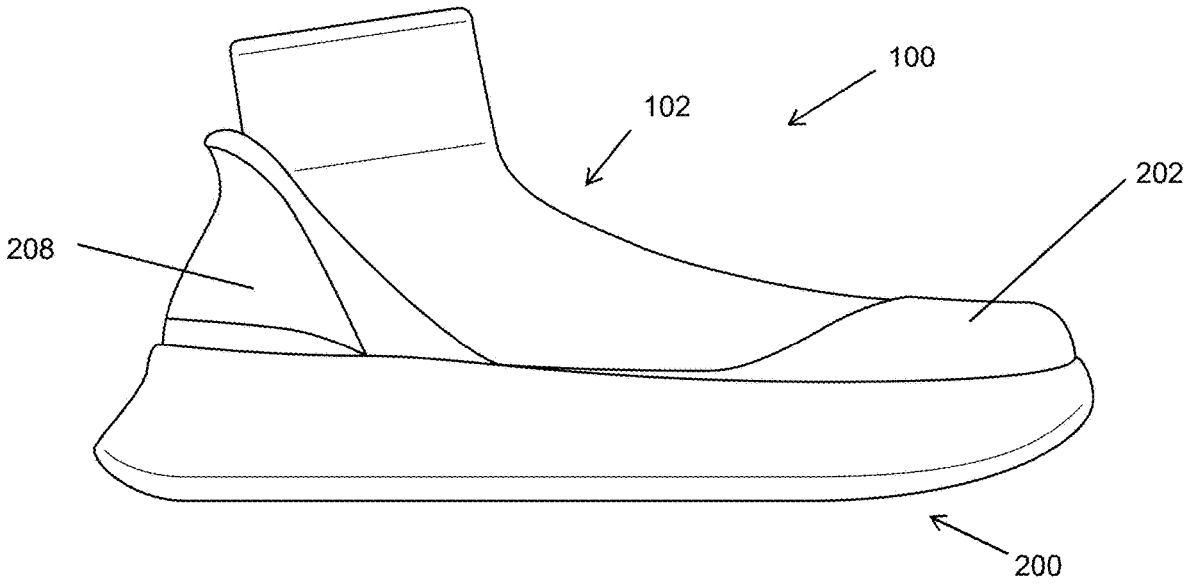
FIG. 4 is a side view of a footwear system in one example.
Figure 5:
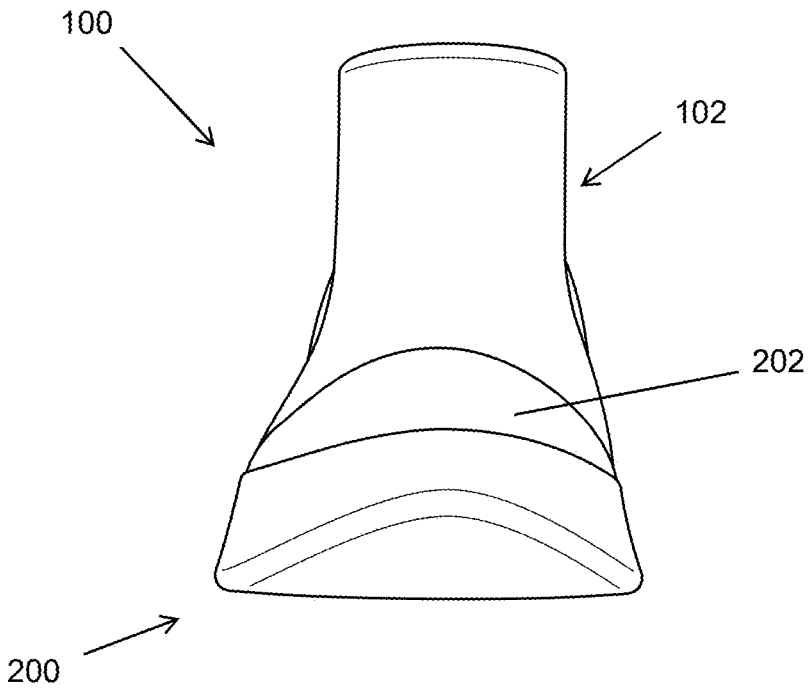
FIG. 5 is a front view of a footwear system in one example.
Figure 6:
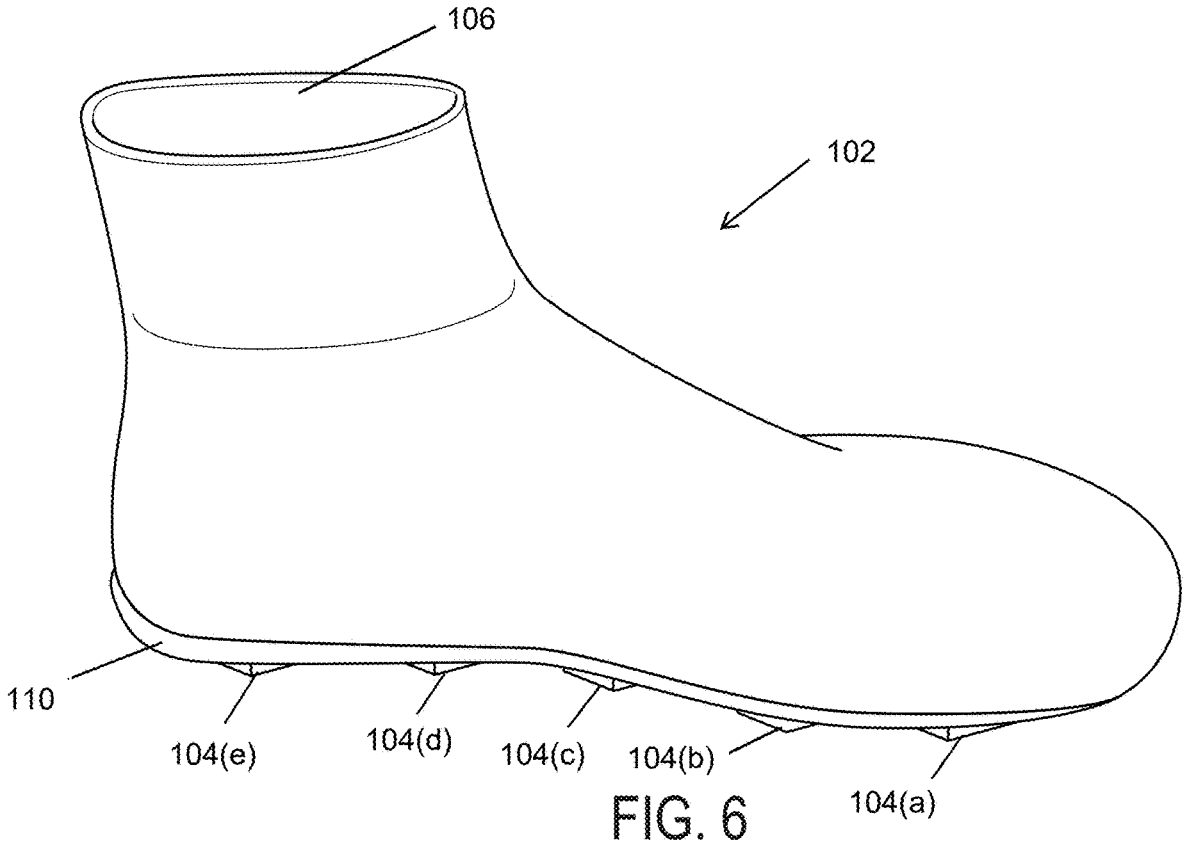
FIG. 6 is an isometric side view of a foot cover in one example.
Figure 7:
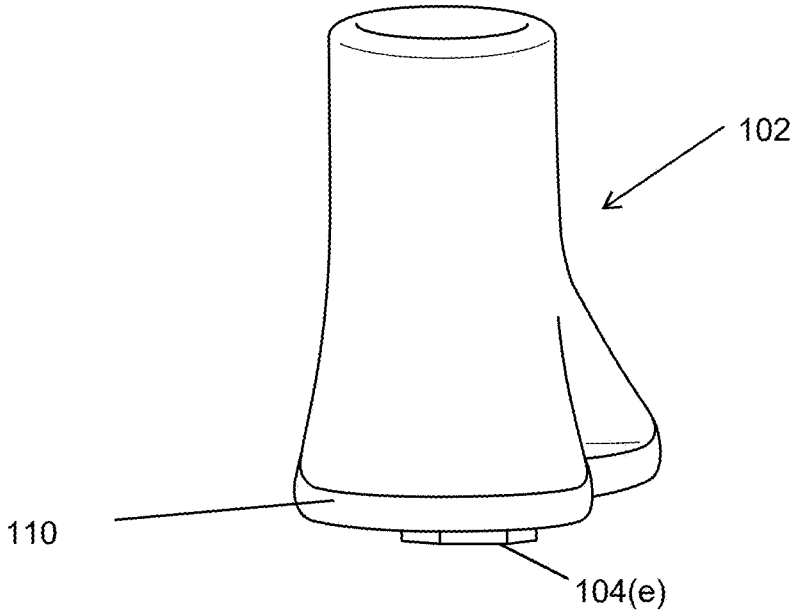
FIG. 7 is a rear view of a foot cover in one example.
Figure 8:
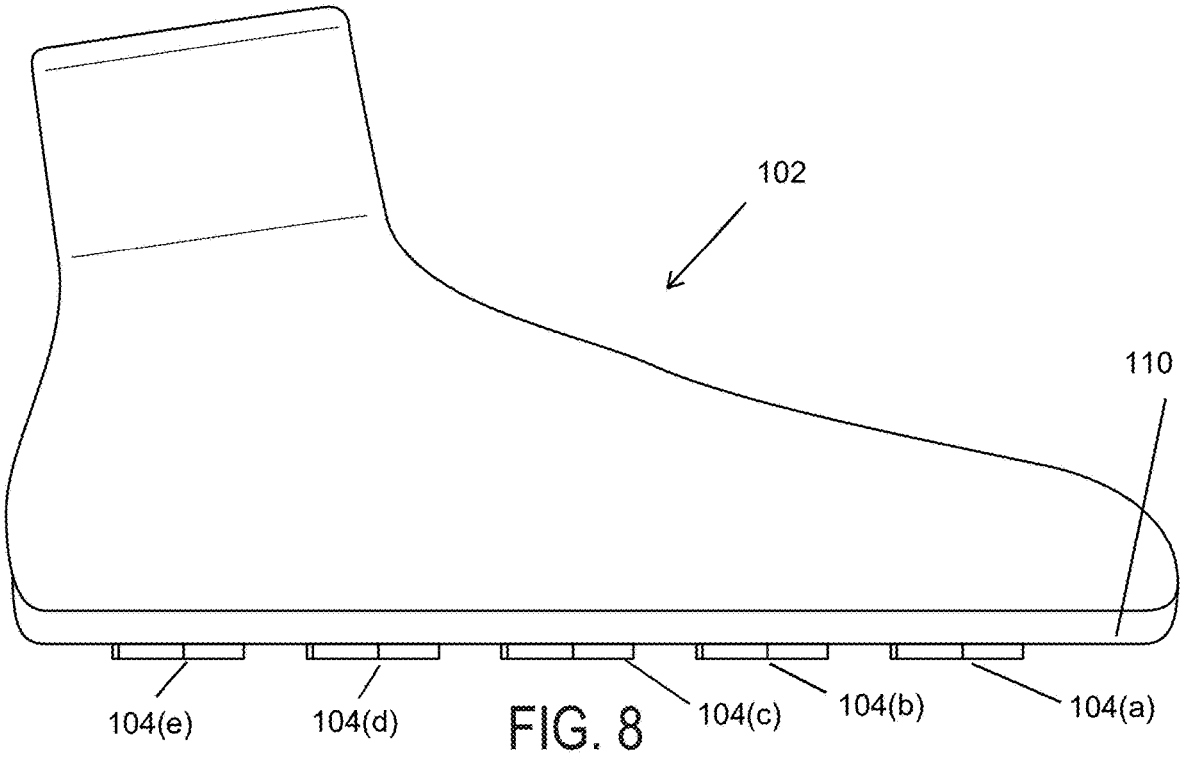
FIG. 8 is a side view of a foot cover in one example.
Figure 9:
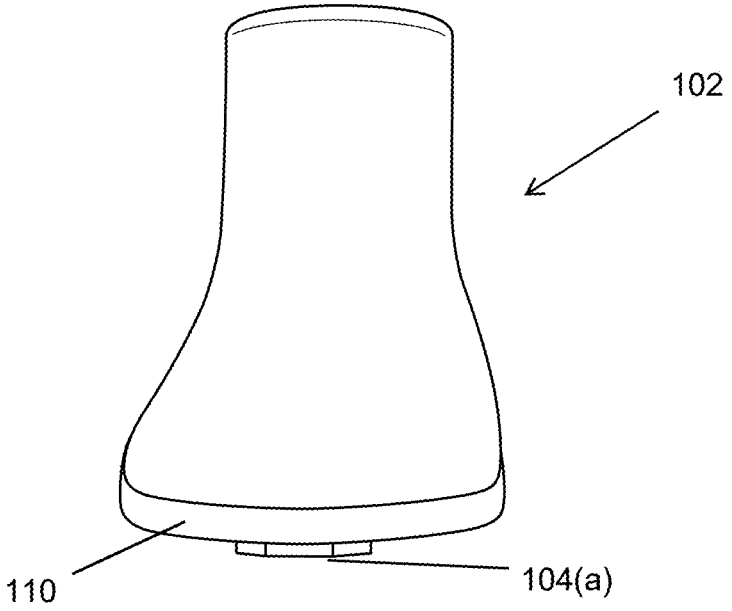
FIG. 9 is a front view of a foot cover in one example.
Figure 10:
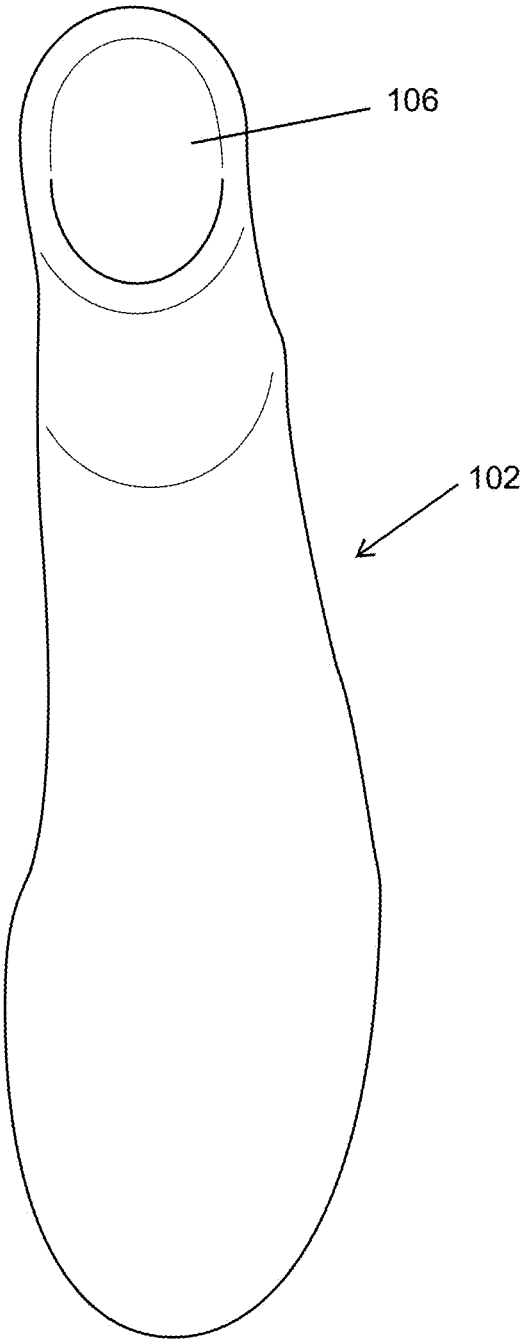
FIG. 10 is a top view of a foot cover in one example.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure. Thus, the following description and drawings are illustrative and are not to be construed as limiting. Numerous specific details are described to provide a thorough understanding of the disclosure. However, in certain instances, well-known or conventional details are not described in order to avoid obscuring the description. References to one or an embodiment in the present disclosure can include references to the same embodiment or any embodiment; and such references mean at least one of the embodiments.

Reference to "one embodiment", "an embodiment", or "an aspect" means that a particular feature, structure, or characteristic described in connection with the embodiment is included in at least one embodiment of the disclosure. The appearances of the phrase "in one embodiment" or "in one aspect" in various places in the specification are not necessarily all referring to the same embodiment, nor are separate or alternative embodiments mutually exclusive of other embodiments. Moreover, various features are described which may be exhibited by some embodiments and not by others.

The terms used in this specification generally have their ordinary meanings in the art, within the context of the disclosure, and in the specific context where each term is used. Alternative language and synonyms may be used for any one or more of the terms discussed herein, and no special significance should be placed upon whether or not a term is elaborated or discussed herein. In some cases, synonyms for certain terms are provided. A recital of one or more synonyms does not exclude the use of other synonyms. The use of examples anywhere in this specification including examples of any terms discussed herein is illustrative only and is not intended to further limit the scope and meaning of the disclosure or of any example term. Likewise, the disclosure is not limited to various embodiments given in this specification.

As used herein, "about" refers to numeric values, including whole numbers, fractions, percentages, etc., whether or not explicitly indicated. The term "about" generally refers to a range of numerical values, for instance, ±0.5-1%, ±1-5% or ±5-10% of the recited value, that one would consider equivalent to the recited value, for example, having the same function or result.

As used herein, "substantially" refers to an amount. The term "substantially" generally refers to "approximately" or "nearly" the amount, for instance ±0.5-5%, ±5-10% or ±10-20% of the amount referenced.

As used herein, "semi-rigid" refers to a material that is still and solid but not inflexible.

Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims or can be learned by the practice of the principles set forth herein.

Provided herein is a footwear system. The footwear system provides significant benefits over current market shoes and socks. For example, the footwear system described herein can provide a foot cover (e.g., sock) with enhanced grip and cushioning. The foot cover can be used indoors or outdoors. The base (e.g., sole) described herein can be interchangeable with different foot covers. Further, the foot cover described herein can be interchangeable with different bases. The footwear system provided herein can also provide the support and strength of a typical shoe, while also providing breathability to the user.

FIGS. 1-5 illustrate a footwear system 100. The footwear system 100 can include a foot cover 102 and a base 200. The foot cover 102 can be operable to removably couple to the base 200, as illustrated, for example, in FIGS. 2-5. The base 200 can provide additional support for the foot cover 102. For example, when coupled to the foot cover 102, the base 200 can provide additional heel and/or toe support to a wearer of the foot cover 102. The base 200 can also provide additional cushion to the foot cover 102. In some examples, the base 200 provides a barrier between the foot cover 102 and the ground. When coupled to the base 200, the top side of the foot cover 102 can be open to the air, thereby providing breathability (e.g., the base 200 does not entirely enclose the foot cover 102).

In some examples, the foot cover 102 can include a sock-like material. For example, the foot cover 102 can include cloth, cotton, wool, and/or other sock like materials. The foot cover 102 can provide the same comfort to a wearer as a typical sock. FIGS. 6-11 illustrate the foot cover 102.

In some examples, the foot cover 102 can include a toe portion (e.g., nearest the toes of the wearer in use) and a heel portion (e.g., nearest the heel of the wearer in use).

The foot cover 102 can include an opening 106. The opening 106 can receive the wearer's foot. The wearer can insert their foot through the opening 106 and secure the foot cover 102 in substantially the same way as a wearer would secure a regular sock.

Figure 11:
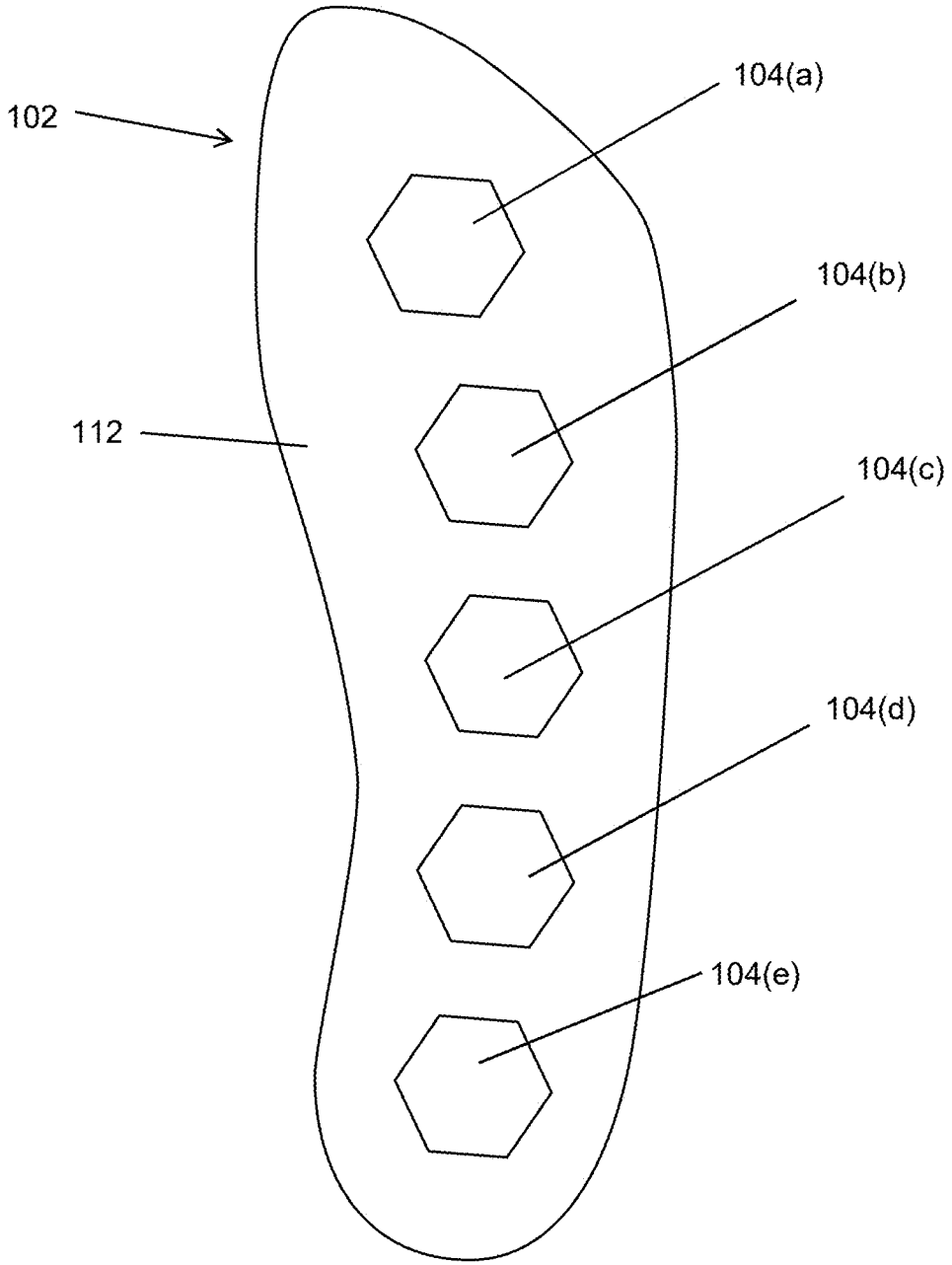
FIG. 11 is a bottom view of a foot cover in one example.
Figure 12:
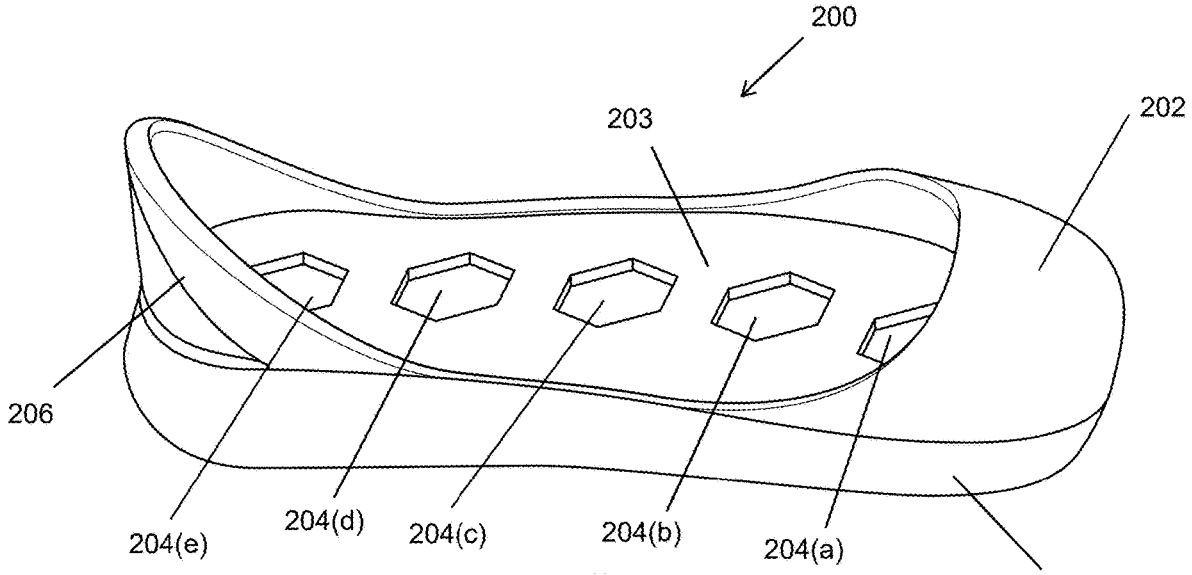
FIG. 12 is an isometric side view of a base in one example.
Figure 13:
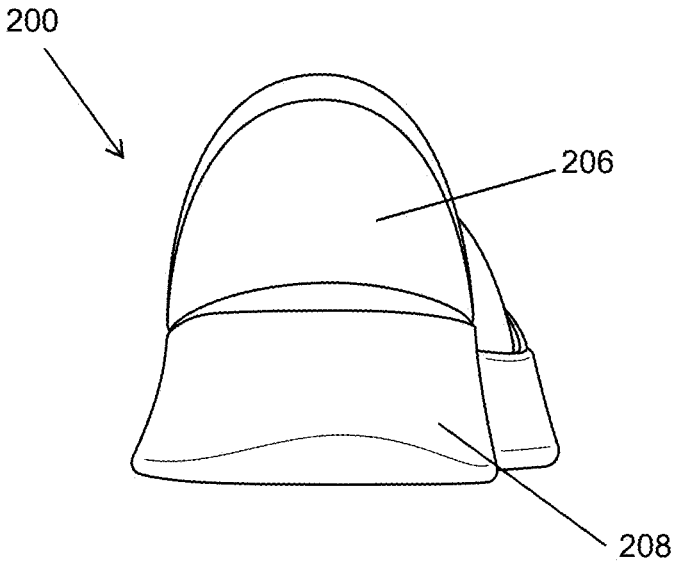
FIG. 13 is a rear view of a base in one example.
Figure 14:
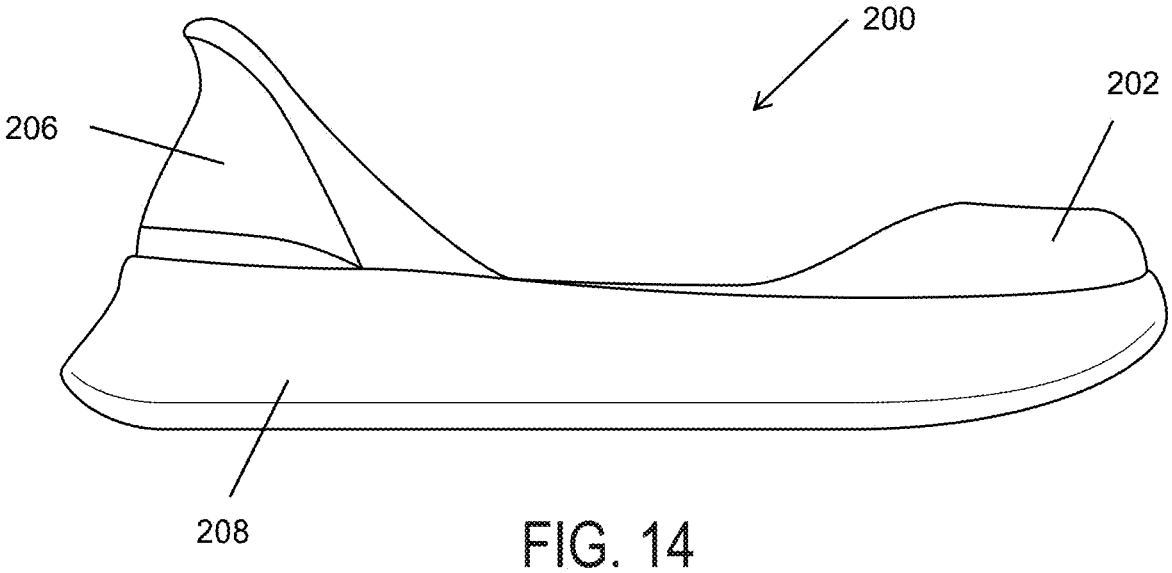
FIG. 14 is a side view of a base in one example.
Figure 15:
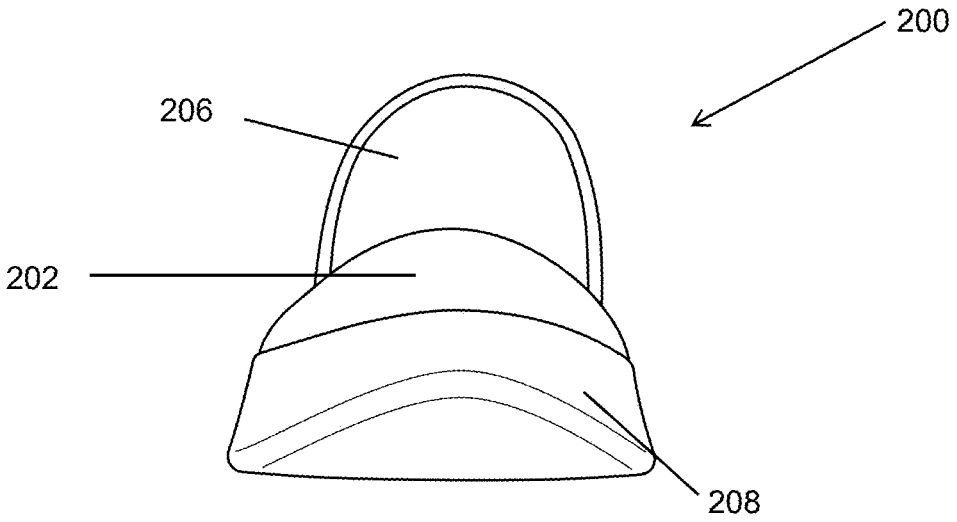
FIG. 15 is a front view of a base in one example.
Figure 16:
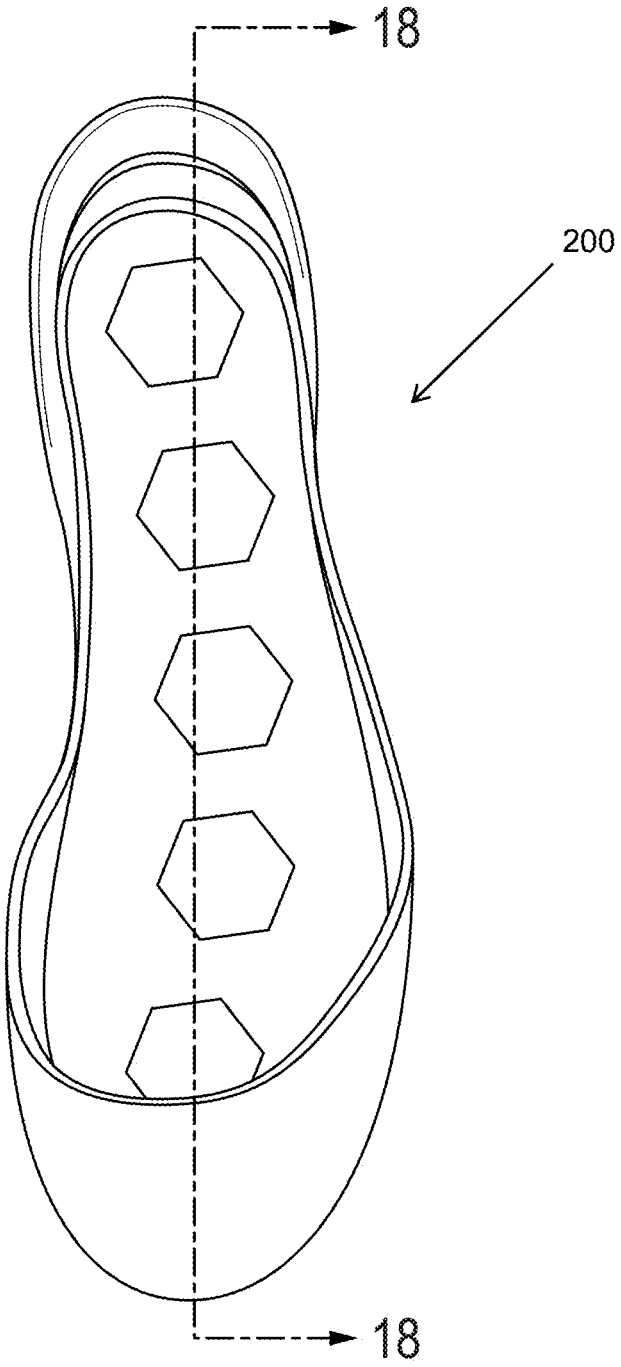
FIG. 16 is a top view of a base in one example having section line 18-18.
Figure 17:
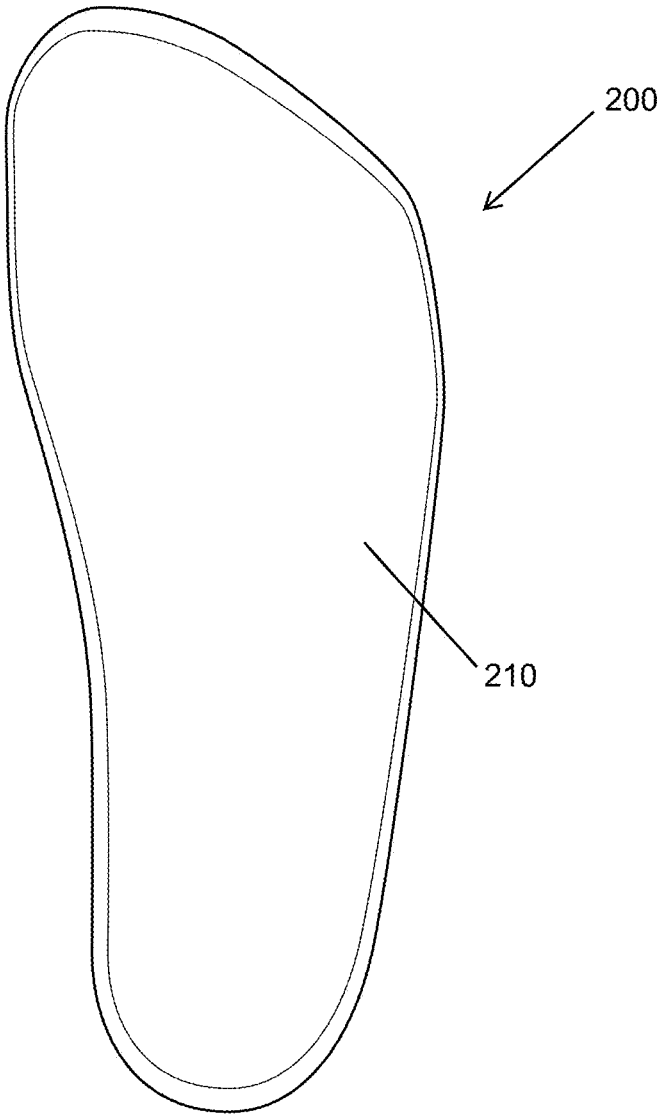
FIG. 17 is a bottom view of a base in one example.
Figure 18:
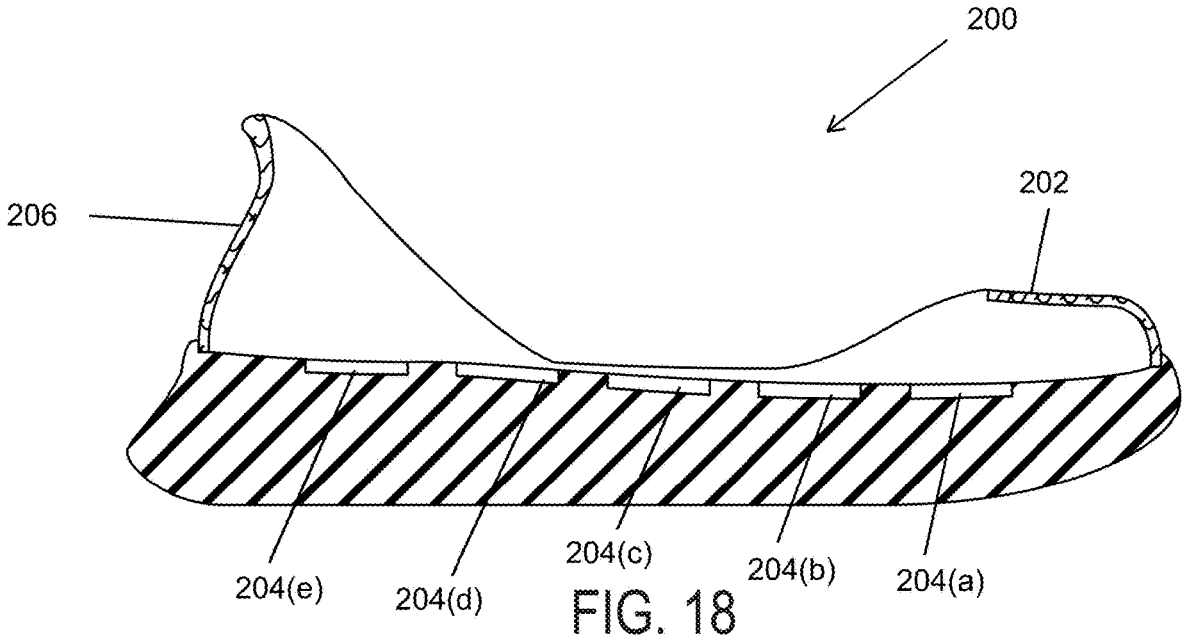
FIG. 18 is a cross sectional view through section line 18-18 of FIG. 16.

The foot cover 102 can include a bottom surface 112, as illustrated for example, in FIG. 11. In some examples, the bottom surface 112 of the foot cover 102 can be a bottom surface of a sole 110 of the foot cover 102. For example, the sole 110 can be formed of a rigid or semi-rigid material to provide additional support, cushioning, and/or grip to the wearer. In other examples, the bottom surface 112 of the foot cover 102 does not include a sole 110. When the bottom surface 112 of the foot cover 102 does not include a sole, the bottom surface 112 can be formed from the same material as the remainder of the foot cover 102.

The foot cover 102 can include a plurality of foot cover coupling mechanisms 104(*a*), 104(*b*), 104(*c*), 104(*d*), 104(*e*) configured to couple to the base 200. The plurality of foot cover coupling mechanisms 104(*a*), 104(*b*), 104(*c*), 104(*d*), 104(*e*) can be attached to the bottom surface 112 of the foot cover 102. In some examples, the plurality of foot cover coupling mechanisms 104(*a*), 104(*b*), 104(*c*), 104(*d*), 104(*e*) can protrude outward from the bottom surface 112, as illustrated, for example, in FIG. 8. In other examples, the plurality of foot cover coupling mechanisms 104(*a*), 104(*b*), 104(*c*), 104(*d*), 104(*e*) can be indented into the bottom surface 112 of the foot cover 102. In other examples, the plurality of foot cover coupling mechanisms 104(*a*), 104(*b*), 104(*c*), 104(*d*), 104(*e*) can be substantially even with bottom surface 112 (e.g., not protrude or indent).

In some examples, the plurality of foot cover coupling mechanisms 104(*a*), 104(*b*), 104(*c*), 104(*d*), 104(*e*) can provide additional grip when used without the base 200. For example, when the plurality of foot cover coupling mechanisms 104(*a*), 104(*b*), 104(*c*), 104(*d*), 104(*e*) are protrusions from the bottom surface 112, the plurality of foot cover coupling mechanisms 104(*a*), 104(*b*), 104(*c*), 104(*d*), 104(*e*) can provide increased grip (e.g., friction) to the floor as the wearer walks in the foot cover 102. Therefore, the wearer can wear the foot cover 102 indoors and have increased grip. Further, the plurality of foot cover coupling mechanisms 104(*a*), 104(*b*), 104(*c*), 104(*d*), 104(*e*) can provide sufficient strength to the foot cover 102 such that a wearer can wear the foot cover 102 outdoors as well.

Although five coupling mechanisms are shown, it will be appreciated that any number of coupling mechanisms can be included. For example, the foot cover can have one to fifty coupling mechanisms, any value therebetween, or more than fifty coupling mechanisms.

In some examples, the plurality of foot cover coupling mechanisms 104(*a*), 104(*b*), 104(*c*), 104(*d*), 104(*e*) can include Velcro, snap-fit connectors, or other attachment means. In some examples, the plurality of foot cover coupling mechanisms 104(*a*), 104(*b*), 104(*c*), 104(*d*), 104(*e*) include a material that protrudes outward from the bottom surface 112 of the foot cover 102. The material protruding outward from the bottom surface 112 can then have Velcro, snap-fit connectors, or other attachment means on the distal end (e.g., end furthest from the bottom surface 112).

In some examples, the plurality of foot cover coupling mechanisms 104(*a*), 104(*b*), 104(*c*), 104(*d*), 104(*e*) can have a shape. In some examples, the shape can include one or more of triangles, rectangles, squares, pentagons, hexagons, heptagons, octagons, or other shapes. In some examples, when the plurality of foot cover coupling mechanisms 104(*a*), 104(*b*), 104(*c*), 104(*d*), 104(*e*) protrude from the bottom surface, the shape of the plurality of foot cover coupling mechanisms 104(*a*), 104(*b*), 104(*c*), 104(*d*), 104(*e*) provides an interlocking feature when coupling to the base 200, as will be described further herein.

FIGS. 12-18 illustrate a base 200. The base 200 can include a sole 208 and an interior surface 203. In some examples, the sole 208 includes a rigid material, a semi-rigid material, or a flexible material. In some examples, the sole 208 includes rubber or EVA foam. In some examples, the sole 208 can be operable to provide shock absorption as a wearer runs or walks. In some examples, the sole 208 is flexible or semi-flexible. For example, the sole 208 can be flexible such that the sole 208 absorbs shocks as the wearer runs or walks.

In some examples, the base 200 can further include a toe cover 202. In some examples, the toe cover 202 can extend from the interior surface 203 near a toe end of the base 200. In some examples, the toe cover 202 can be operable to cover a toe area of the foot cover 102 when the foot cover 102 is installed in the base, as illustrated, for example, in FIGS. 2-5. In some examples, the foot cover 102 fits securely within the toe cover 202 (e.g., the toe cover 202 provides compression on the foot cover 102, and thereby the wearer's foot). In some examples, the toe cover 202 can enclose at least a toe portion of the foot cover 102. In some examples, the toe cover 202 can be integral to the base 200 (e.g., manufactured as one piece). In other examples, the toe cover 202 can be removably coupled to the base 200. For example, the toe cover 202 can include one or more coupling mechanisms configured to removably couple to one or more corresponding coupling mechanisms of the base 200. In some examples, the toe cover 202 can removably couple to the base via one or more snap fit mechanisms.

In some examples, the base 200 can further include a heel support 206. In some examples, the heel support 206 can extend from a portion of the interior surface 203 of the base 200. In some examples, the heel support 206 can provide support to a wearer's heel when the foot cover 102 is installed in the base 200. In some examples, the heel support 206 can be integral to the base 200 (e.g., the heel support 206 and the base 200 can be manufactured as one piece), as illustrated, for example, in FIGS. 12-18.

The base 200 can further include a plurality of base coupling mechanisms 204(*a*), 204(*b*), 204(*c*), 204(*d*), 204(*e*). The plurality of base coupling mechanisms 204(*a*), 204(*b*), 204(*c*), 204(*d*), 204(*e*) can be operable to removably couple to the plurality of foot cover coupling mechanisms

104(*a*), 104(*b*), 104(*c*), 104(*d*), 104(*e*), as illustrated, for example, in FIG. 1. In some examples, the plurality of base coupling mechanisms 204(*a*), 204(*b*), 204(*c*), 204(*d*), 204(*e*) can be attached to the interior surface 203 of the base 200. In some examples, the plurality of base coupling mechanisms 204(*a*), 204(*b*), 204(*c*), 204(*d*), 204(*e*) can be housed within indents in the interior surface 203 (e.g., the plurality of base coupling mechanisms 204(*a*), 204(*b*), 204(*c*), 204(*d*), 204(*e*) can be within the base 200 below the interior surface 203), as illustrated, for example, in FIG. 18. In some examples, the plurality of base coupling mechanisms 204(*a*), 204(*b*), 204(*c*), 204(*d*), 204(*e*) can protrude from the interior surface 203 (e.g., extend out from the interior surface 203). In other examples, the plurality of base coupling mechanisms 204(*a*), 204(*b*), 204(*c*), 204(*d*), 204(*e*) can be substantially even with interior surface 203 (e.g., not protrude or indent).

Although five base coupling mechanisms are shown, it will be appreciated that any number of coupling mechanisms can be included. For example, the base 200 can include one to fifty base coupling mechanisms, any value therebetween, or more than fifty base coupling mechanisms. In some examples, the plurality of foot cover coupling mechanisms 104(*a*), 104(*b*), 104(*c*), 104(*d*), 104(*e*) and the plurality of base coupling mechanisms 204(*a*), 204(*b*), 204(*c*), 204(*d*), 204(*e*) have the same number of coupling mechanisms (e.g., each foot cover coupling mechanism has a corresponding base coupling mechanism).

In some examples, the plurality base coupling mechanisms 204(*a*), 204(*b*), 204(*c*), 204(*d*), 204(*e*) can include Velcro, snap-fit connections, or other attachment means. In some examples, both the plurality of foot cover coupling mechanisms 104(*a*), 104(*b*), 104(*c*), 104(*d*), 104(*e*) and the plurality of base coupling mechanisms 204(*a*), 204(*b*), 204(*c*), 204(*d*), 204(*e*) include Velcro. In some examples, both the plurality of foot cover coupling mechanisms 104(*a*), 104(*b*), 104(*c*), 104(*d*), 104(*e*) and the plurality of base coupling mechanisms 204(*a*), 204(*b*), 204(*c*), 204(*d*), 204(*e*) include snap-fit connectors.

In some examples, the plurality of base coupling mechanisms 204(*a*), 204(*b*), 204(*c*), 204(*d*), 204(*e*) can have shape. In some examples, the shape can include one or more of triangles, rectangles squares, pentagons, hexagons, heptagons, octagons, or other shapes. When the plurality of base coupling mechanisms 204(*a*), 204(*b*), 204(*c*), 204(*d*), 204(*e*) are indented in the interior surface 203 and the plurality of foot cover coupling mechanisms 104(*a*), 104(*b*), 104(*c*), 104(*d*), 104(*e*) have protrusions, the plurality of base coupling mechanisms 204(*a*), 204(*b*), 204(*c*), 204(*d*), 204(*e*) and the plurality of foot cover coupling mechanisms 104(*a*), 104(*b*), 104(*c*), 104(*d*), 104(*e*) can have the same shape. When the plurality of foot cover coupling mechanisms 104(*a*), 104(*b*), 104(*c*), 104(*d*), 104(*e*) are coupled to the plurality of base coupling mechanisms 204(*a*), 204(*b*), 204(*c*), 204(*d*), 204(*e*), the shapes of the coupling mechanisms, in conjunction with the protruded coupling mechanisms and indented corresponding coupling mechanisms, can provide an interlocking effect (e.g., the plurality of foot cover coupling mechanisms 104(*a*), 104(*b*), 104(*c*), 104(*d*), 104(*e*) and the plurality of base coupling mechanisms 204(*a*), 204(*b*), 204(*c*), 204(*d*), 204(*e*) are prevented from rotating with respect to one another). In this manner, the foot cover 102 and the base 200 are interlocked together such that the foot cover 102 and the base 200 support the wearer's foot without slipping (e.g., rotation) between the foot cover 102 and the base 200.

Figure 19:
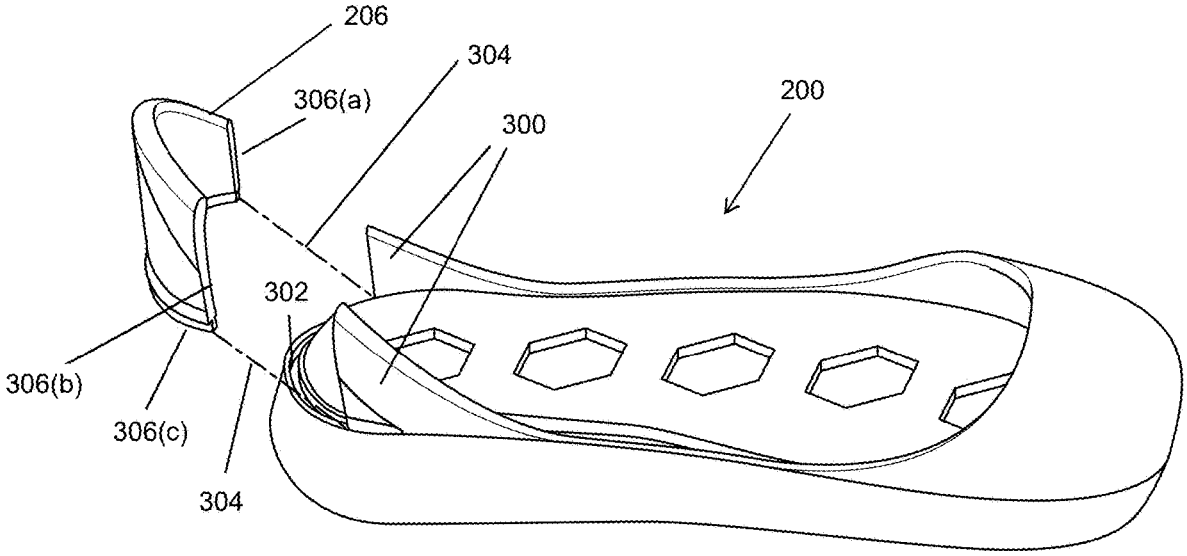
FIG. 19 is an isometric side view of a base in one example.
Figure 20:
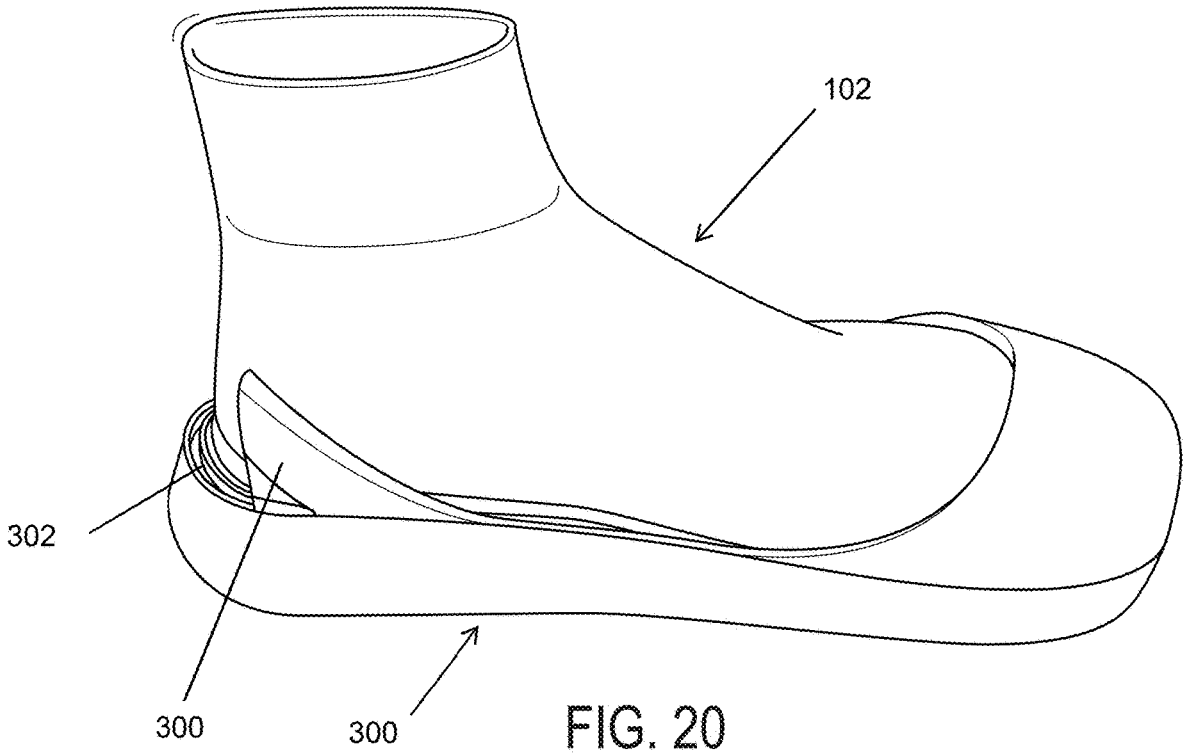
FIG. 20 is an isometric side view of a footwear system in one example.
Figure 21:
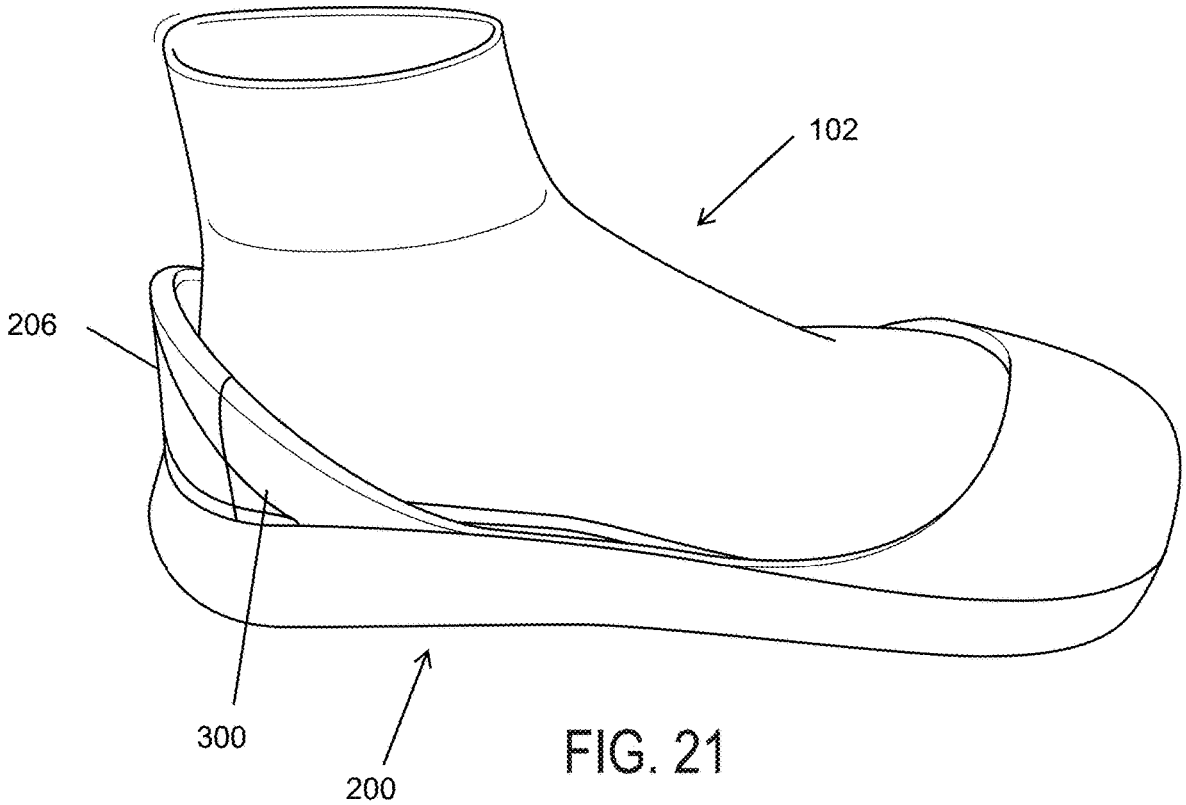
FIG. 21 is an isometric side view of a footwear system in one example.
Figure 22:
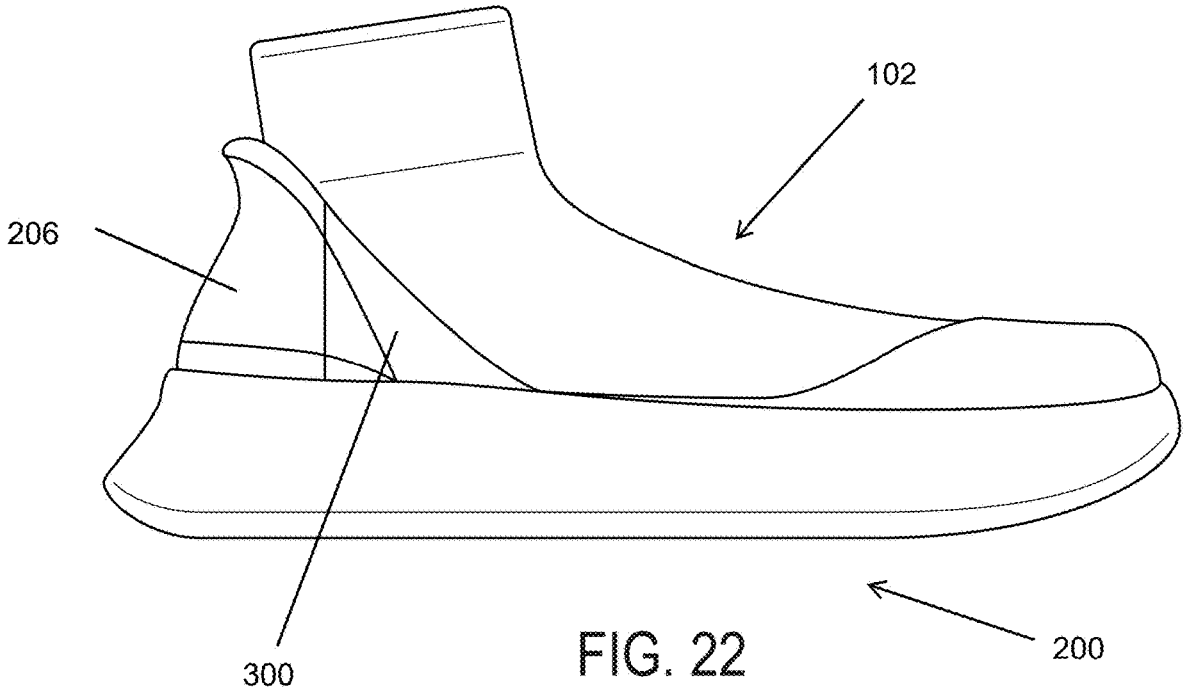
FIG. 22 is a side view of a footwear system in one example.
Figure 23:
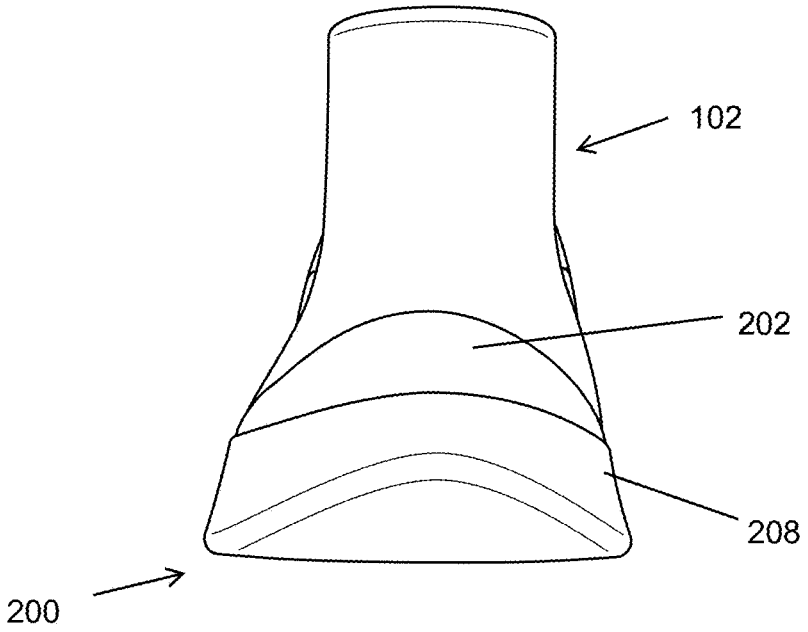
FIG. 23 is a front view of a footwear system in one example.
Figure 24:
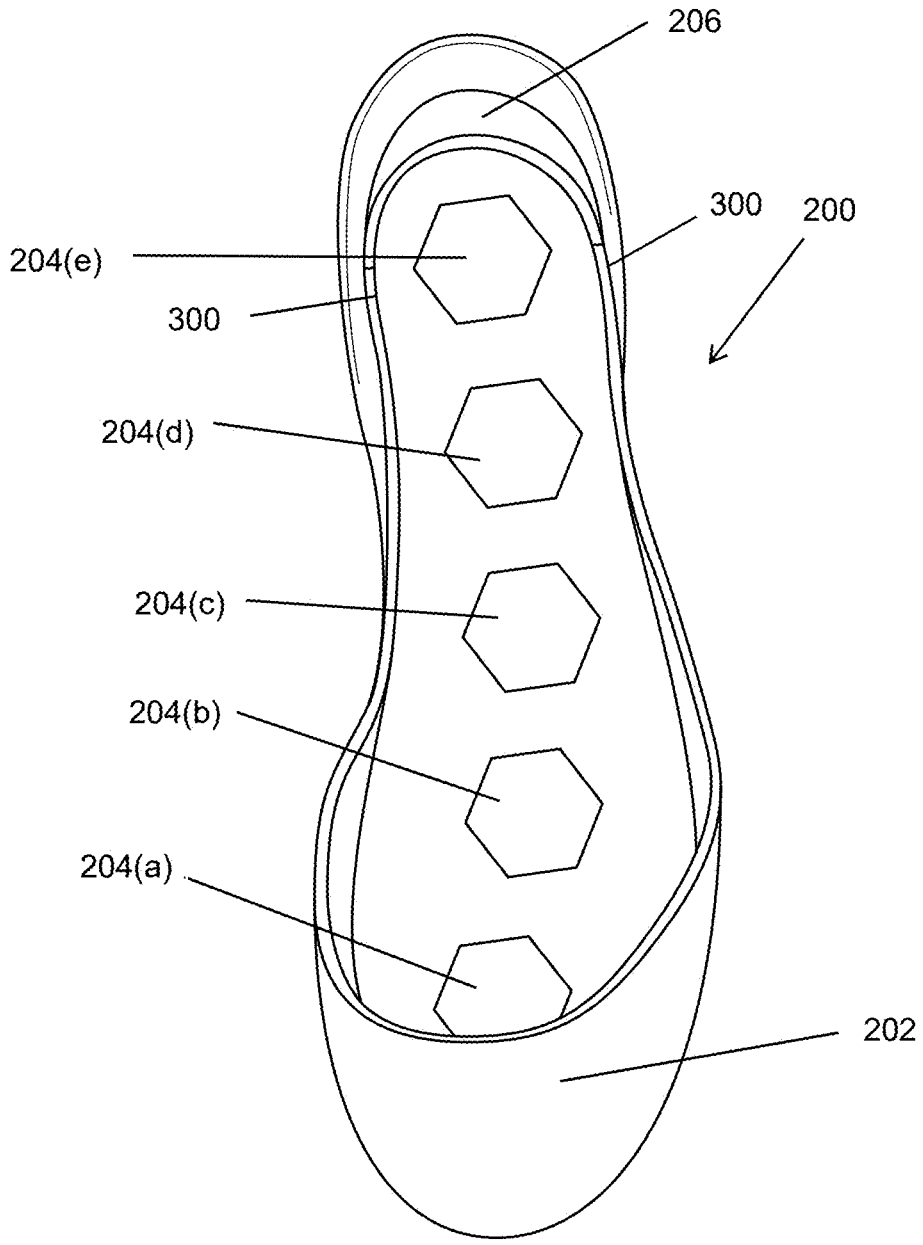
FIG. 24 is a top view of a footwear system in one example.

In some examples, the heel support 206 can be removable from the base 200, as illustrated, for example, in FIGS. 19-24. The heel support 206 can include one or more heel coupling mechanisms (e.g., heel coupling mechanisms 306(*a*), 306(*b*), 306(*c*)). In some examples, the base 200 can include one or more heel base coupling mechanisms 302. In some examples, the one or more heel coupling mechanisms 306(*a*), 306(*b*), 306(*b*) of the heel support 206 can be operable to removably couple to the one or more heel base coupling mechanisms 302. Connection lines 304 of FIG. 19 illustrate the heel support 206 being coupled to the base 200.

In some examples, a base heel support portion 300 can be integral to the base 200 and the remainder of the heel support 206 can be removably coupled to the base, as illustrated in FIG. 19. The base heel support portion 300 and the heel support 206 can provide heel support to a wearer when the heel support 206 is coupled to the base 200.

Figure 25:
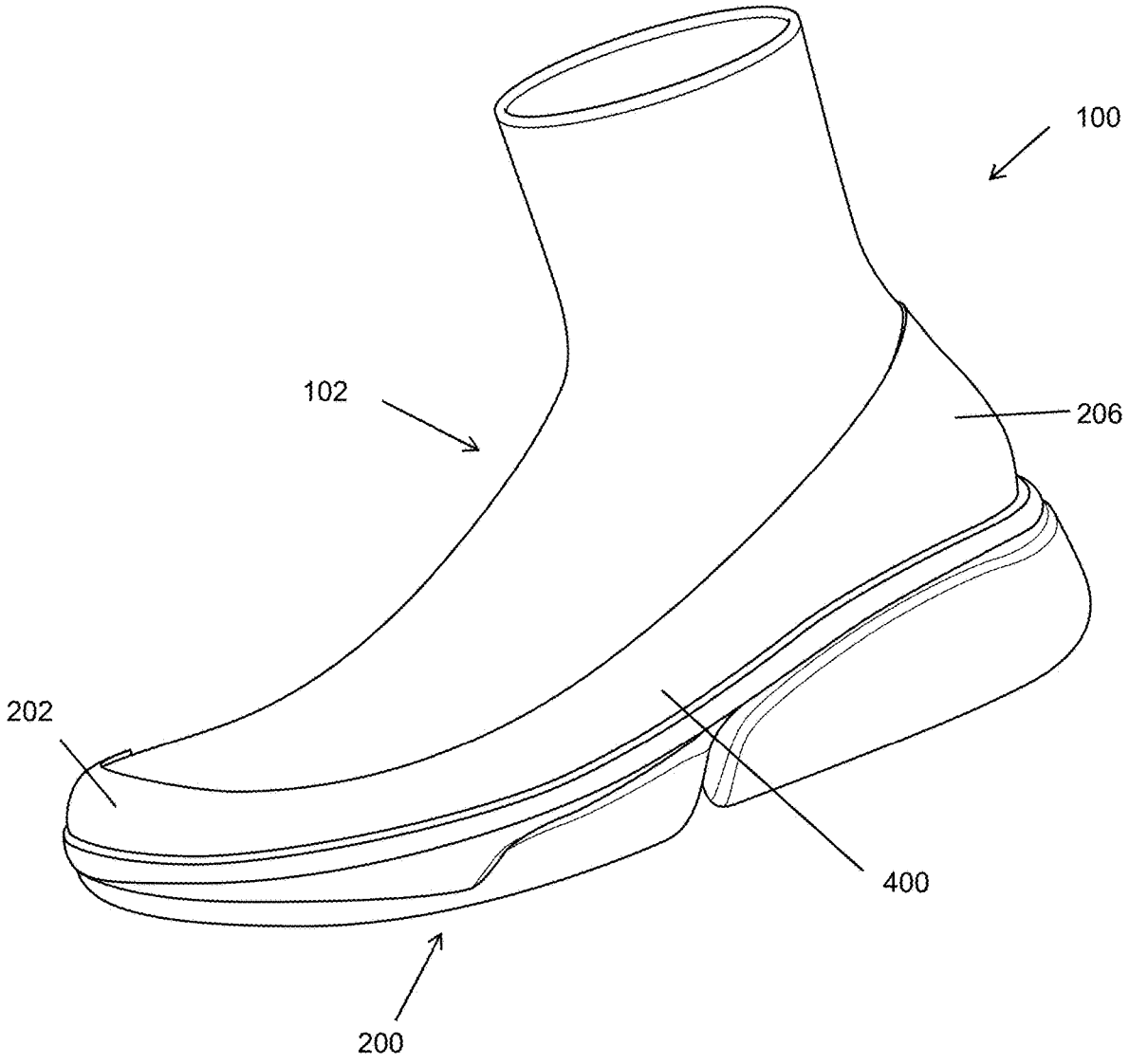
FIG. 25 is an isometric side view of a footwear system in one example.

As illustrated in FIG. 25, the base can include side walls 400 connecting the toe cover 202 to the heel support 206. The side walls 400 can provide additional support to the wearer's foot. In some examples, the side walls 400, the toe cover 202, and the heel support 206 can all be manufactured as one piece. In some examples, the side walls 400, the toe cover 202, and the heel support 206 can be integral with the base 200 (e.g., manufactured as one piece).

Figure 26:
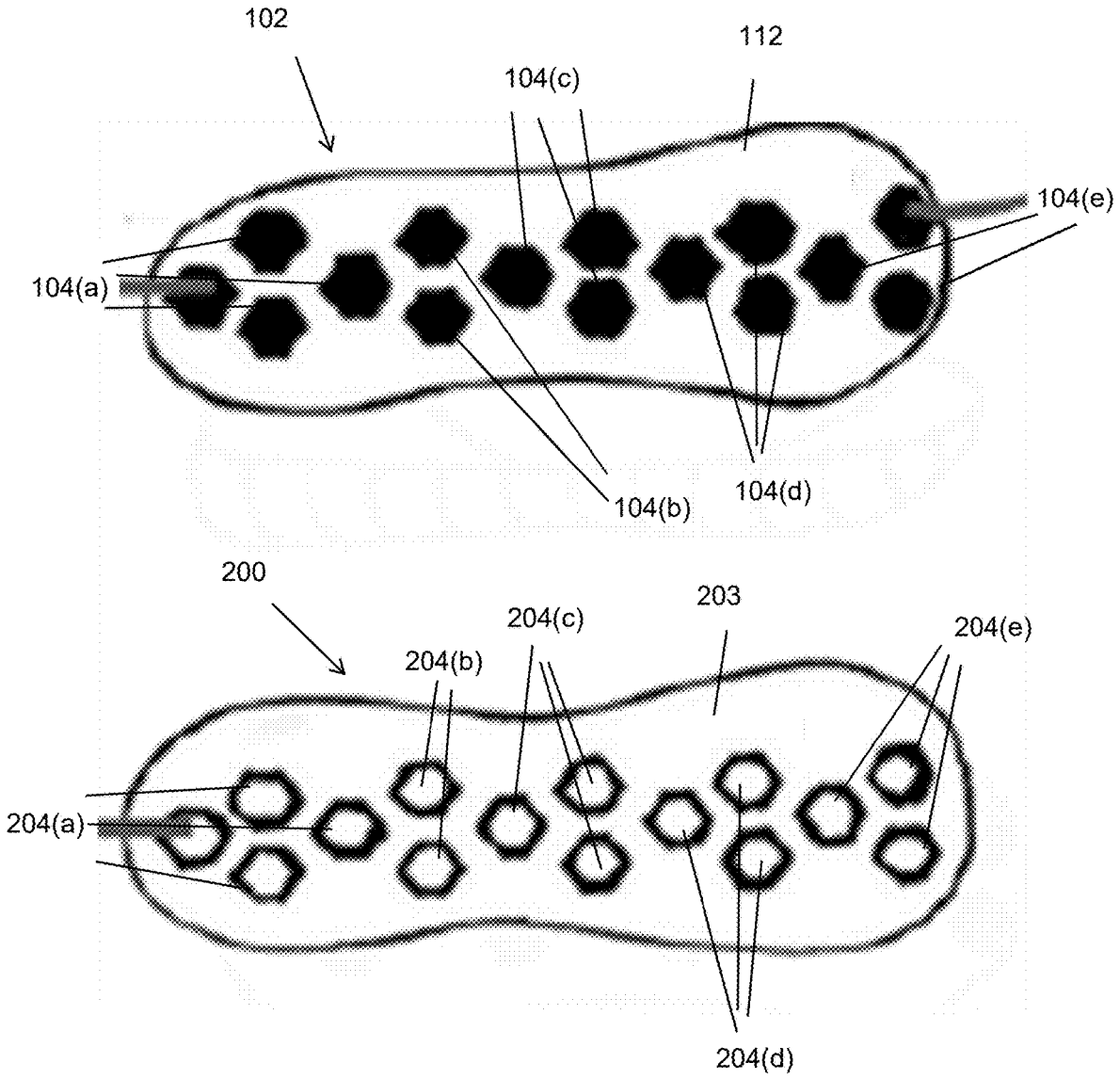
FIG. 26 illustrates a bottom surface of a foot cover and an interior surface of a base in one example.

In some examples, the plurality of foot cover coupling mechanisms 104(*a*), 104(*b*), 104(*c*), 104(*d*), 104(*e*) and the plurality of base coupling mechanisms 204(*a*), 204(*b*), 204(*c*), 204(*d*), 204(*d*) can be arranged in a honeycomb array, as illustrated in FIG. 26. Although FIG. 26 only shows two rows of coupling mechanisms in the honeycomb array, it will be appreciated that more rows of coupling mechanisms can be used. In some examples, substantially all of the interior surface 203 of the base and the bottom surface 112 of the foot cover 102 are covered by the honeycomb array. In some examples, when the honeycomb array of coupling mechanisms covers substantially all of the interior surface 203 and the bottom surface 112, the coupling mechanisms can interlock forming a secure connection between the foot cover 102 and the base 200.

Referring back to FIG. 1, the foot cover 102 can be coupled with the base 200. Attachment line 108 generally shows the alignment of the foot cover 102 to the base 200 when coupled together. The foot cover 102 can first be secured to a wearer's foot. For example, the wearer can insert their foot through the top opening 106 and secure the foot cover 102 to their foot (e.g., in substantially the same way a wearer would put on a regular sock). The wearer can then insert a toe portion of the foot cover 102 (e.g., area near foot cover coupling mechanism 104(*a*)) into the toe cover 202 of the base 200. The wearer can extend the foot cover 102 into the toe cover 202 until the foot cover 102 abuts a front interior edge (e.g., furthest frontward position within the toe cover 202) of the toe cover 202.

Once the foot cover 102 is properly positioned within the toe cover 202, the wearer can press their foot downward, thereby providing a force between foot cover coupling mechanism 104(*a*) (e.g., foot cover coupling mechanism 104(*a*) is near the toe area of foot cover 102) and base coupling mechanism 204(*a*) (e.g., base coupling mechanism 204(*a*) is near the toe area of the base 200). For example, the wearer can push their toes downward while keeping their heel elevated away from the base 200. The force provided by the user pressing their foot down can be operable to couple the foot cover coupling mechanism 104(*a*) to the base coupling mechanism 204(*a*). In some examples, when foot cover coupling mechanism 104(*a*) includes a protrusion having a shape and base coupling mechanism 204(*a*) includes an indent having the same shape, the force can be operable to interlock the protrusion of the foot cover coupling mechanism 104(*a*) with the indent of the base coupling mechanism 204(*a*).

Once the coupling mechanisms of the foot cover 102 and the base 200 near the toe area (e.g., near toe cover 202) of the footwear system 100 are coupled, the wearer can begin coupling the remaining coupling mechanisms. For example, the wearer can push their heel downward, thereby providing a force to push foot cover coupling mechanisms 104(*b*), 104(*c*), 104(*d*), 104(*e*) into base coupling mechanisms 204(*a*), 204(*b*), 204(*c*), 204(*d*), 204(*e*). The force provided by the wearer pushing their heal downward can be operable to couple foot cover coupling mechanisms 104(*b*), 104(*c*), 104(*d*), 104(*e*) to base coupling mechanisms 204(*b*), 204(*c*), 204(*d*), 204(*e*). In some examples, when the foot cover coupling mechanisms 104(*b*), 104(*c*), 104(*d*), 104(*e*) include protrusions having a shape and base coupling mechanisms 204(*b*), 204(*c*), 204(*d*), 204(*e*) include indents having a corresponding shape, the force can be operable to interlock the protrusions of the foot cover mechanisms 104(*b*), 104(*c*), 104(*d*), 104(*e*) with the indents of the base cover mechanisms 204(*b*), 204(*c*), 204(*d*), 204(*e*).

In some examples, when the heel support 206 is integral, the force provided by the wearer pushing their heel downward also secures the heel support 206 to the heel of the wearer. In this manner, the wearer has properly secured the foot cover 102 to the base 200. The footwear system 100 provides toe support via toe cover 202 and heel support via heel support 206. Further, the plurality of foot cover coupling mechanisms 104(*a*), 104(*b*), 104(*c*), 104(*d*), 104(*e*) and the plurality of base coupling mechanisms 204(*a*), 204(*b*), 204(*c*), 204(*d*), 204(*e*) provide securement between the foot cover 102 and the base 200.

In some examples, when the heel support 206 is removable from the base 200, the foot cover 102 can be coupled to the base 200 in substantially the same way as described herein. However, after all of the plurality of foot cover coupling mechanisms 104(*a*), 104(*b*), 104(*c*), 104(*d*), 104(*e*) are coupled to the base coupling mechanisms 204(*a*), 204(*b*), 204(*c*), 204(*d*), 204(*e*), the heel support 206 can then be coupled to the base 200 by coupling heel support mechanisms 306(*a*), 306(*b*), 306(*c*) to the one or more heel base coupling mechanisms 302. In some examples, having a removable heel support 206 aids in the attachment process of the foot cover 102 and the base 200. For example, the foot cover 102 can be entirely coupled to the base 200, in the manner described herein, without any interference from the heel support 206. Then once the foot cover 102 is secured to the base, the heel support 206 can be attached.

In some examples, the foot cover 102 can be operatively engaged to the base 200 when the toe portion of the foot cover 102 is first enclosed by the toe cover 202, the plurality of foot cover coupling mechanisms 104(*a*), 104(*b*), 104(*c*), 104(*d*), 104(*e*) can then be coupled to the plurality of base coupling mechanisms 204(*a*), 204(*b*), 204(*c*), 204(*d*), 204(*e*). Then the heel portion of the foot cover 102 can be engaged to the heel support 206.

Removing the foot cover 102 from the base 200 can be conducted in a reverse manner to the attachment of the foot cover 102 to the base 200. For example, first a wearer can remove the heel support 206 (e.g., if the heel support 206 is removable). If the heel support 206 is integral to the base 200, the step of removing the heel support 206 can be skipped. Next, the wearer can secure the base 200 such that it does not move with the foot cover 102. For example, a wearer can grip the base 200 with their hand or use another method to hold the base 200 in place. The wearer can then pull their heel away from the base 200, thereby uncoupling foot cover coupling mechanism 104(*e*) and base coupling mechanism 204(*e*). The wearer can then similarly pull their foot away from the base 200, which pulls the foot cover 102 away from the base 200. As the foot cover 102 is pulled away from the base 200, the foot cover coupling mechanisms 104(*d*), 104(*c*), 104(*b*) can be uncoupled from the base coupling mechanisms 204(*d*), 204(*c*), 204(*b*). The wearer can then provide a force pulling the foot cover coupling mechanism 104(*a*) (e.g., the foot cover coupling mechanism nearest the toe cover) from the base coupling mechanism 204(*a*) (e.g., the base coupling mechanism nearest the toe cover 202). The force can uncouple foot coupling mechanism 104(*a*) from base coupling mechanism 204(*a*). The wearer can then remove the toe portion of the foot cover 102 from the toe cover 202, thereby entirely uncoupling the foot cover 102 from the base 200.

By enabling easy removal and attachment of the foot cover 102 and the base 200, different bases and/or foot covers can be used with one another. In this manner, the user can have a plurality of different designs of bases and foot covers to mix and match. Further, some bases can provide different properties than others. For example, some bases can be suited for different activities (e.g., running, hiking, etc.), thereby providing a wearer with different bases for different purposes.

Figure 27:
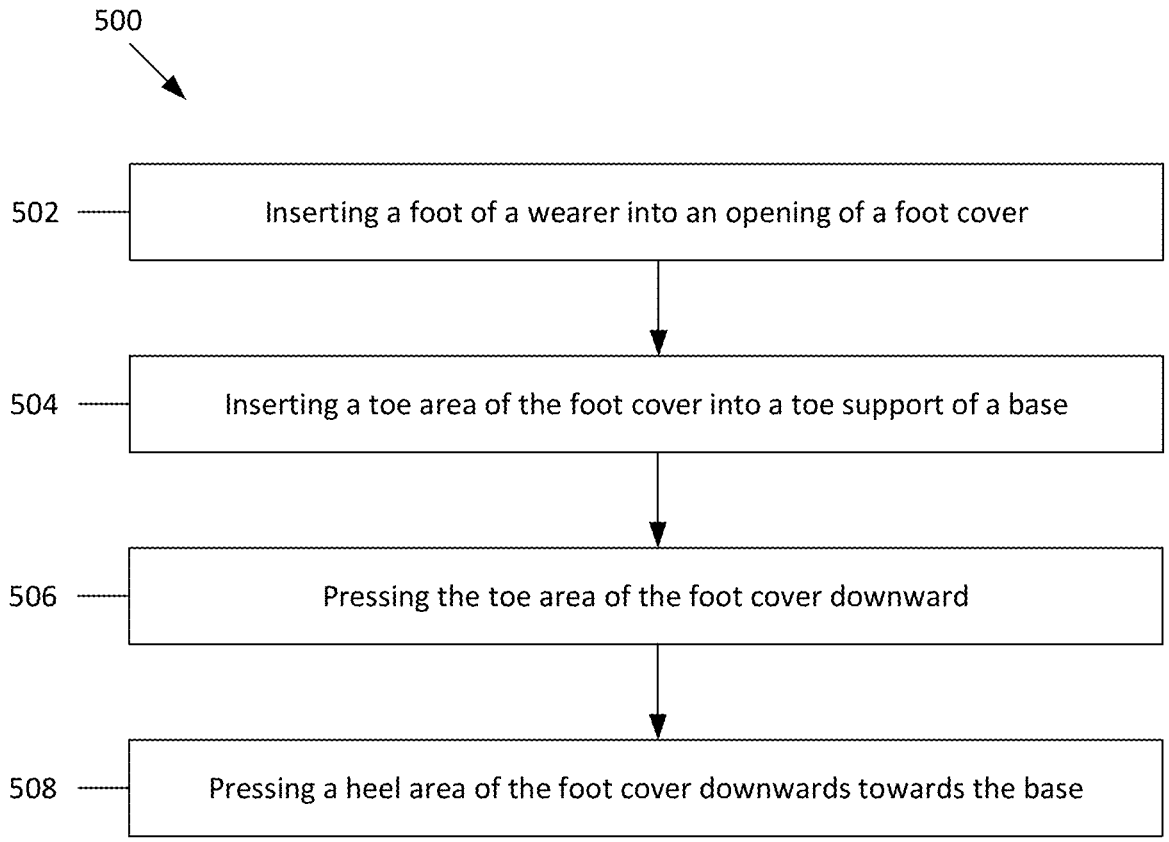
FIG. 27 is a flowchart of a method for securing modular footwear.

Further provided herein is a method for securing modular footwear. FIG. 27 illustrates an exemplary method 500 for securing modular footwear. The method 500 can be conducted using the footwear system 100 and any of the components described herein.

The method 500 can begin at block 502. At block 502, the method 500 can include inserting a foot of a wearer into an opening of a foot cover. For example, the wearer can insert their foot in the opening of the foot cover and secure the foot cover in substantially the same way as a wearer would secure a sock. The foot cover can include the plurality of foot cover coupling mechanisms described herein. In some examples, the plurality of foot cover coupling mechanisms can include Velcro, snap-fit connectors, or other attachment means.

At block 504, the method 500 can include inserting a toe area of the foot cover into a toe support (e.g., toe cover) of a base. The base can include the plurality of base coupling mechanisms described herein. The plurality of base coupling mechanisms can include Velcro, snap-fit connectors, or other attachment means.

At block 506, the method 500 can include pressing the toe area of the foot cover downward. Pressing the toe cover downward can be operable to couple one or more of the plurality of foot cover coupling mechanisms near the toe area to one or more of the plurality of base coupling mechanisms near the toe area.

At block 508, the method 500 can include pressing a heel area of the foot cover downwards towards the base. Pressing the heel area downward can be operable to couple one or more remaining coupling mechanisms of the plurality of foot cover coupling mechanisms to one or more remaining corresponding coupling mechanisms of the plurality of base coupling mechanisms.

In some examples, the method 500 can further include coupling a heel support to the base, thereby providing heel support to the wearer. The heel support can include one or more snap-fit connectors to removably couple to a corresponding snap-fit connector of the base. In some examples, the heel support is integral to the base and does not need to be coupled, as described herein.

In some examples, the method 500 can further include removing the foot cover from the base. When a removable heel support is included, the heel support can be removed before the foot cover is removed from the base. Removing the foot cover from the base can include securing the base (e.g., by holding the base with a hand of the wearer). Removing the foot cover from the base can further include pulling the one or more remaining coupling mechanisms (e.g., coupling mechanisms near the heel and/or midfoot of the foot cover) from the one or more remaining corresponding coupling mechanisms (e.g., base coupling mechanisms near the heel and/or midfoot). Pulling the one or more remaining coupling mechanisms (e.g., coupling mechanisms near the heel and/or midfoot of the foot cover) from the one or more remaining corresponding coupling mechanisms (e.g., base coupling mechanisms near the heel and/or midfoot) can uncouple the one or more remaining coupling mechanisms from the one or more remaining corresponding coupling mechanisms.

Removing the foot cover from the base can further include pulling the one or more of the plurality of foot cover coupling mechanisms near the toe area from the one or more of the plurality of base coupling mechanisms near the toe area. In this manner, the one or more of the plurality of foot cover coupling mechanisms near the toe area can be uncoupled from the one or more of the plurality of base coupling mechanisms near the toe area.

In some examples, the plurality of foot cover coupling mechanisms and the plurality of base coupling mechanisms can be arranged in a honeycomb array, as described herein. In some examples, the honeycomb array can cover substantially an entire surface of the bottom surface of the foot cover and the interior surface of the base.

In some examples, the bottom surface of the foot cover includes a sole. In some examples, the plurality of foot cover coupling mechanisms are attached to the sole. In some examples, the plurality of foot cover coupling mechanisms can include protrusions extending from the bottom surface of the foot cover and the plurality of base coupling mechanisms can include indents into the interior surface of the base. In some examples the protrusions can be configured to interlock with the indents, thereby preventing any rotational movement between the foot cover and the base. In some examples, the plurality of foot cover coupling mechanisms and the plurality of base coupling mechanisms can include Velcro and/or snap-fit mechanisms.

The disclosures shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the examples described above may be modified within the scope of the appended claims.

What is claimed is:

1. A footwear system comprising:

a foot cover operable to secure around a foot of a wearer, the foot cover comprising a toe portion, a heel portion, and a bottom surface comprising a plurality of foot cover coupling mechanisms; and a base comprising:

an interior surface comprising a plurality of base coupling mechanisms, the plurality of base coupling mechanisms operable to removably couple to the plurality of foot cover coupling mechanisms;

a toe cover extending from a portion of the interior surface and operable to enclose at least a portion of the toe portion of the foot cover; and a removable heel support extending from a portion of the interior surface and operable to support at least a portion of the heel portion of the foot cover, wherein the foot cover is operatively engaged to the base when the toe portion of the foot cover is first enclosed by the toe cover, the plurality of foot cover coupling mechanisms are then coupled to the plurality of base coupling mechanisms, and then the heel portion of the foot cover is engaged to the removable heel support, and wherein the removable heel support is operable to removably couple to the base.

2. The footwear system of claim 1, wherein the foot cover comprises a sock.

3. The footwear system of claim 1, wherein the bottom surface further comprises a sole, and wherein the plurality of foot cover coupling mechanisms are attached to the sole.

4. The footwear system of claim 1, wherein the plurality of foot cover coupling mechanisms include protrusions extending from the bottom surface and the plurality of base coupling mechanisms include indents into the interior surface, and wherein the protrusions are configured to interlock with the indents.

5. The footwear system of claim 1, wherein the plurality of foot cover coupling mechanisms and the plurality of base coupling mechanisms comprise hook and loop fasteners and/or snap fit mechanisms.

6. The footwear system of claim 1, wherein the base further comprises side supports.

7. The footwear system of claim 6, wherein the side supports extend from the toe cover to the base.

8. The footwear system of claim 1, wherein the plurality of foot cover coupling mechanisms and the plurality of base coupling mechanisms are arranged in a honeycomb array.

9. The footwear system of claim 8, wherein the honeycomb array covers substantially an entire surface of the bottom surface and the interior surface.

10. A method for securing modular footwear, the method comprising:

inserting a foot of a wearer into an opening of a foot cover, the foot cover comprising a bottom surface comprising a plurality of foot cover coupling mechanisms;

inserting a toe area of the foot cover into a toe cover of a base, the base comprising an interior surface comprising a plurality of base coupling mechanisms;

pressing the toe area of the foot cover downward, thereby coupling one or more of the plurality of foot cover coupling mechanisms near the toe area to one or more of the plurality of base coupling mechanisms near the toe area;

pressing a heel area of the foot cover downward towards the base, thereby coupling one or more remaining coupling mechanisms of the plurality of foot cover coupling mechanisms to one or more remaining corresponding coupling mechanisms of the plurality of base coupling mechanisms; and coupling a removable heel support to the base.

11. The method of claim 10, wherein the removable heel support is operable to support a heel of the wearer.

12. The method of claim 11, wherein coupling the removable heel support to the base comprises connecting at least one snap fit connector of the removable heel support to at least one corresponding snap fit connector of a heel support connector.

13. The method of claim 10, further comprising removing the foot cover from the base by securing the base and pulling the one or more remaining coupling mechanisms away from the one or more remaining corresponding coupling mechanisms, thereby uncoupling the one or more remaining coupling mechanisms from the one or more remaining corresponding coupling mechanisms.

14. The method of claim 13, wherein removing the foot cover from the base further comprises pulling the plurality of foot cover coupling mechanisms near the toe area away from the plurality of base coupling mechanisms near the toe area, thereby uncoupling the plurality of foot cover coupling mechanisms from the plurality of base coupling mechanisms.

15. The method of claim 10, wherein the plurality of foot cover coupling mechanisms and the plurality of base coupling mechanisms are arranged in a honeycomb array.

16. The method of claim 15, wherein the honeycomb array covers substantially an entire surface of the bottom surface and the interior surface.

17. The method of claim 10, wherein the bottom surface of the foot cover comprises a sole, and wherein the plurality of foot cover coupling mechanisms are attached to the sole.

18. The method of claim 10, wherein the plurality of foot cover coupling mechanisms include protrusions extending from the bottom surface and the plurality of base coupling mechanisms include indents into the interior surface, and wherein the protrusions are configured to interlock with the indents.

19. The method of claim 10, wherein the plurality of foot cover coupling mechanisms and the plurality of base coupling mechanisms comprise hook and loop fasteners and/or snap fit mechanisms.

* * * * *